United States Patent [19]
Newberry et al.
[11] 4,200,794
[45] Apr. 29, 1980

[54] MICRO LENS ARRAY AND MICRO DEFLECTOR ASSEMBLY FOR FLY'S EYE ELECTRON BEAM TUBES USING SILICON COMPONENTS AND TECHNIQUES OF FABRICATION AND ASSEMBLY

[75] Inventors: Sterling P. Newberry, Winchester; John R. Burgess, Dunstable, both of Mass.

[73] Assignee: Control Data Corporation

[21] Appl. No.: 958,657

[22] Filed: Nov. 8, 1978

[51] Int. Cl.[2] ..... G21K 1/08; G21K 5/00
[52] U.S. Cl. ..... 250/396 ML; 29/576 R; 250/492 A; 315/382; 315/391
[58] Field of Search ..... 315/391, 382; 313/429, 313/414, 448, 432, 421; 250/396 ML, 492 A; 29/576 R

[56] References Cited

U.S. PATENT DOCUMENTS

| | | | |
|---|---|---|---|
| 3,534,219 | 10/1970 | Newberry | 313/429 X |
| 3,899,711 | 8/1975 | Lemmond | 313/414 |

*Primary Examiner*—Harold A. Dixon
*Attorney, Agent, or Firm*—Charles W. Helzer

[57] ABSTRACT

A combined fine focusing micro lens array and micro deflector assembly for use in electron beam tubes of the fly's eye type is provided. The assembly comprises a fine focusing micro lens array sub-assembly formed from a plurality of spaced-apart stacked parallel thin planar apertured silicon semiconductor lens plates each having an array of micro lens aperture openings. The lens plates each have highly conductive surfaces and are secured to glass rods for holding the plates in stacked parallel spaced-apart relationship with the apertures axially aligned in parallel. A micro deflector assembly is adjacent to the micro lens array sub-assembly. A micro deflector element axially aligned with each respective fine focusing lens element serves for deflecting an electron beam passing through along orthogonal x-y directional axes of movement normal to the electron beam path. The deflector elements are comprised by two orthogonally arrayed sets of parallel spaced-apart deflector bars with alternate bars of each set of deflector bars being interconnected electrically for common connection to a respective source of fine x-y deflection potential.

The thin planar apertured silicon lens plates comprising the micro lens array are held together in stacked parallel assembled relationship by spaced-apart glass support rods whose longitudinal axes extend at right angles to the plates and to which the planar silicon lens plates are secured at their periphery. The two orthogonally arrayed sets of parallel spaced-apart deflection bars forming the sets of micro-deflector elements likewise preferably comprise parallel plates or bars of polycrystalline silicon having a highly conductive metalized surface. The micro deflector bars likewise are held in assembled spaced-apart parallel relationship by respective sets of spaced-apart parallel supporting glass rods whose longitudinal axes extend in a plane parallel to the plane of the deflector bars but at right angles thereto and to which the ends of the deflector bars are thermally bonded. The fine focusing micro lens array and micro deflector sub-assembly thus comprised, are secured together in assembled relation by additional glass support rods being disposed about the outer peripheries of the micro lens and micro deflector sub-assemblies and being secured thereto by thermal bonding such as by fusion.

76 Claims, 54 Drawing Figures

Fig. 12
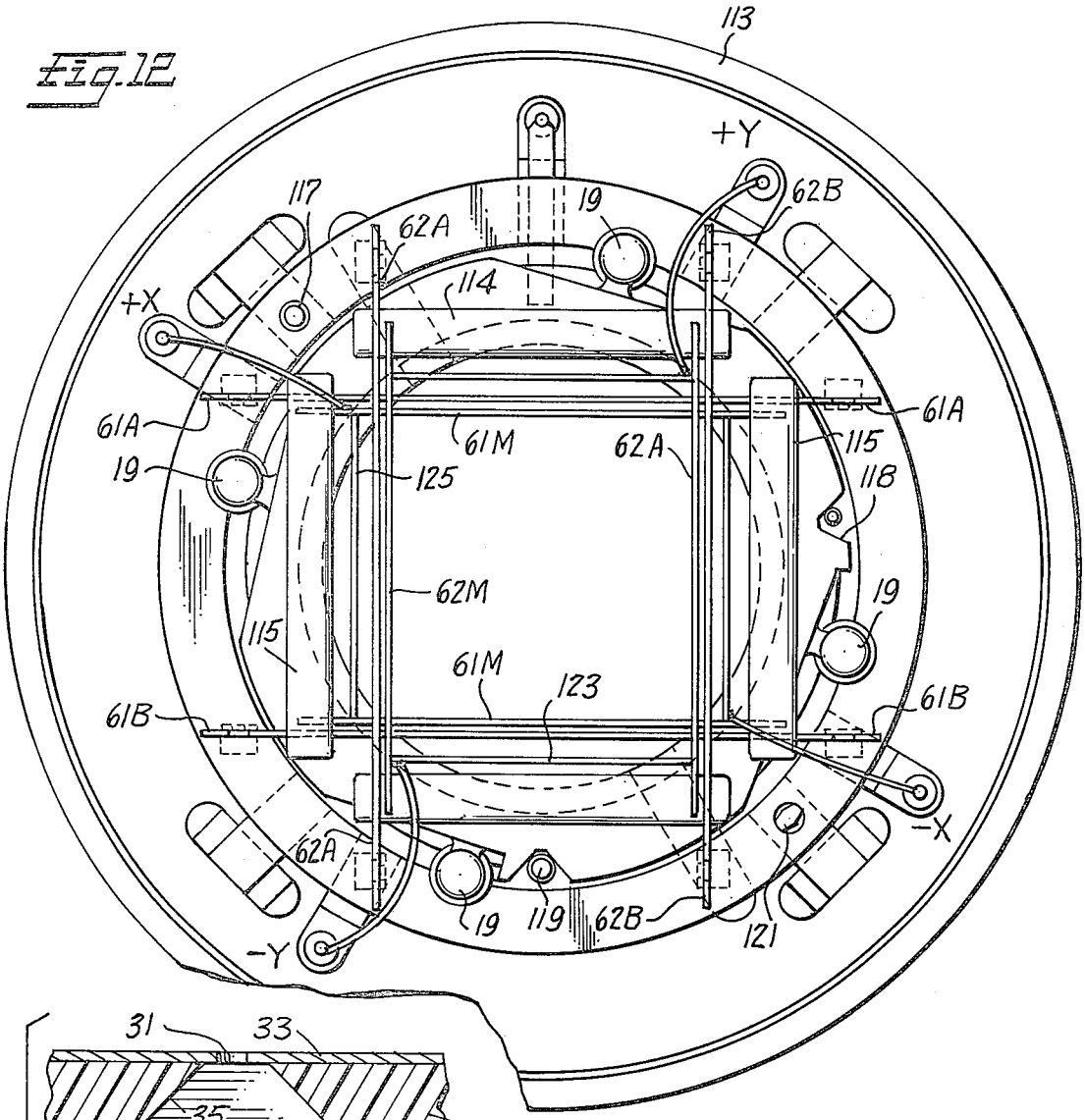
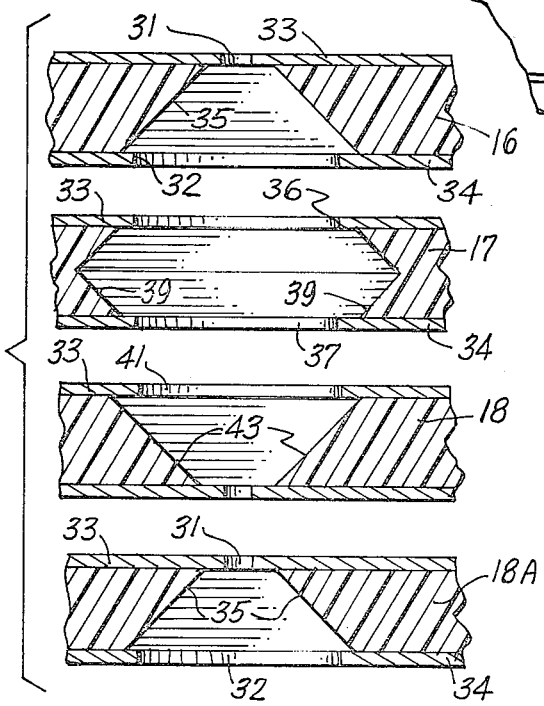
Fig. 17

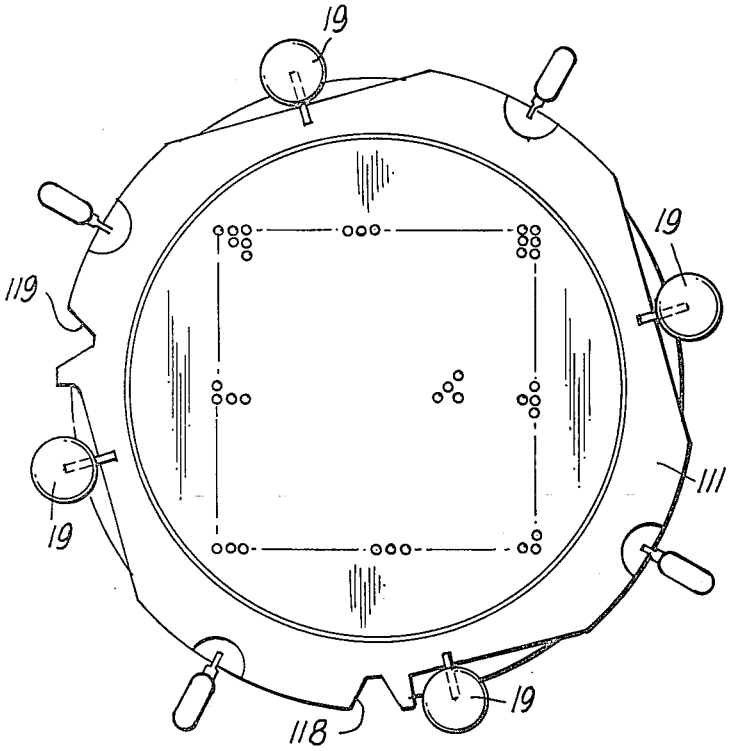
Fig.14
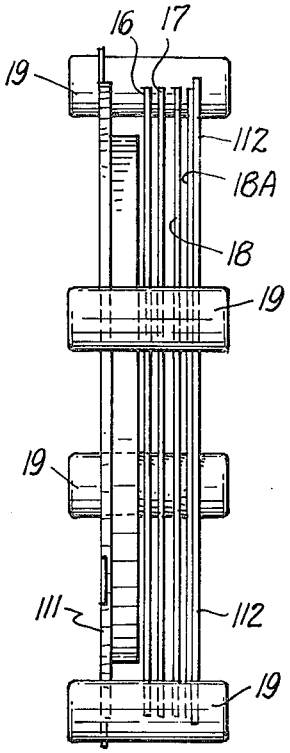
Fig.13
Fig.15
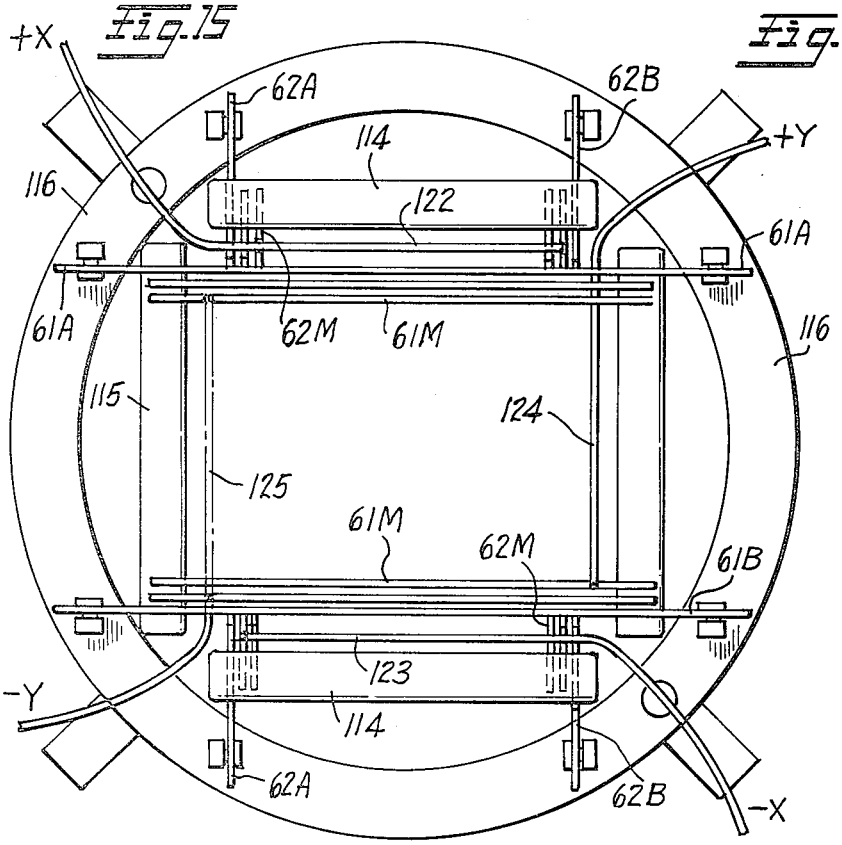
Fig.16
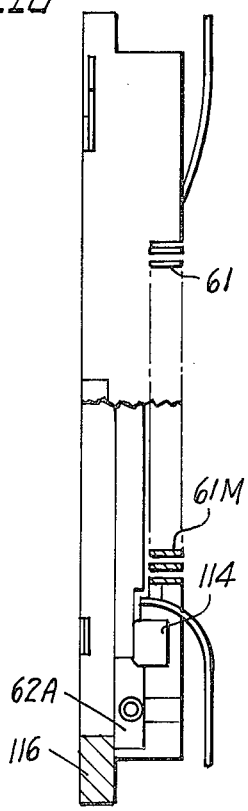

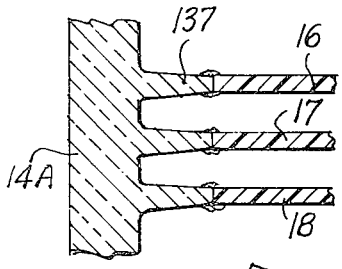
Fig. 22
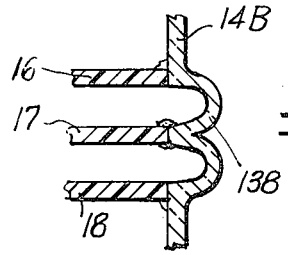
Fig. 22A
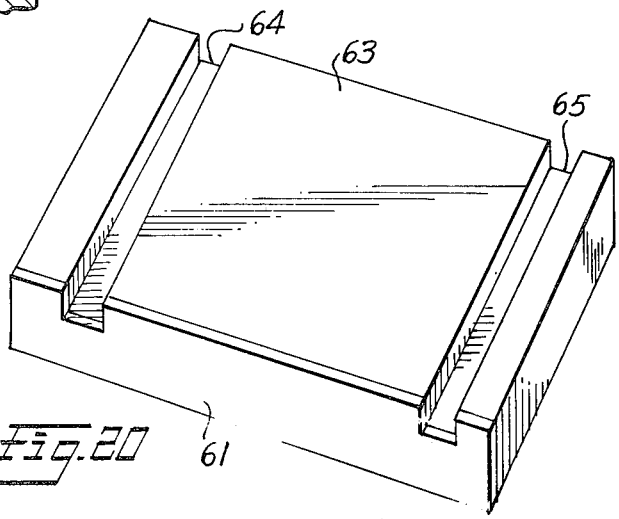
Fig. 20
Fig. 20A
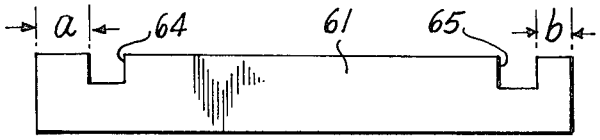
Fig. 20B
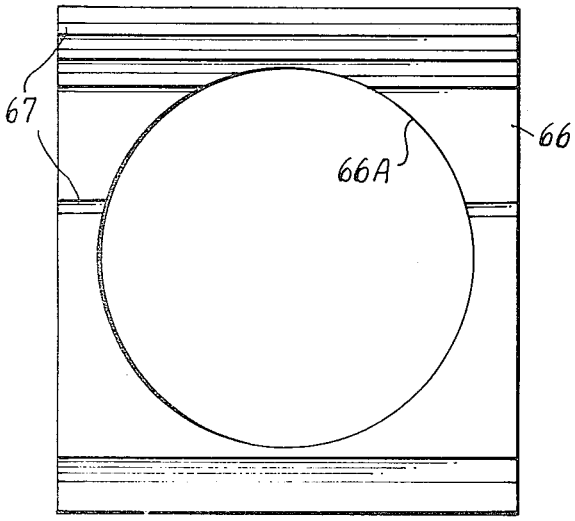
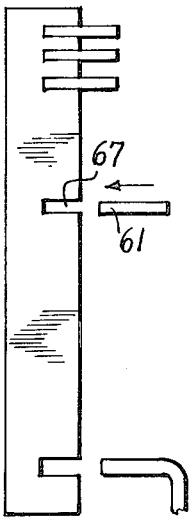
Fig. 20C

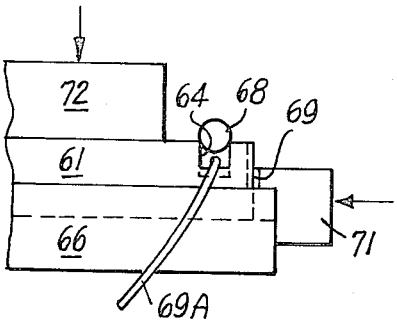
Fig. 20D
Fig. 20E
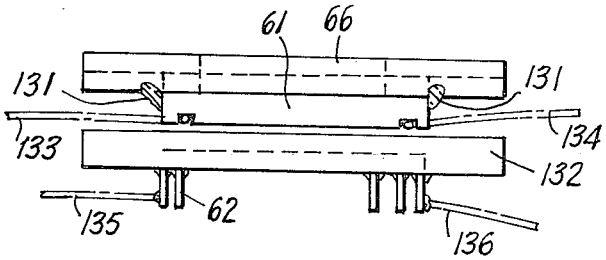
Fig. 20F
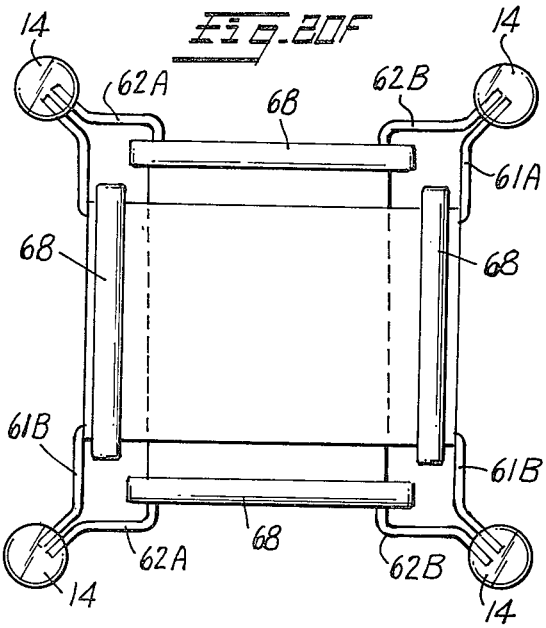
Fig. 23
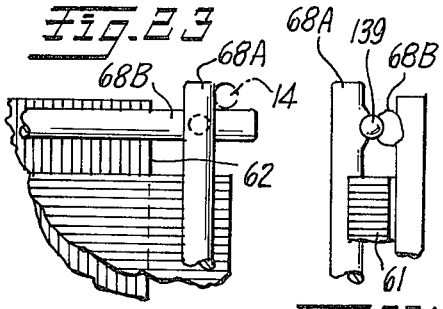
Fig. 23A
Fig. 21
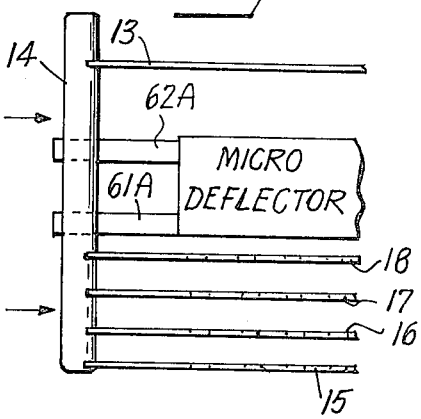
Fig. 21A
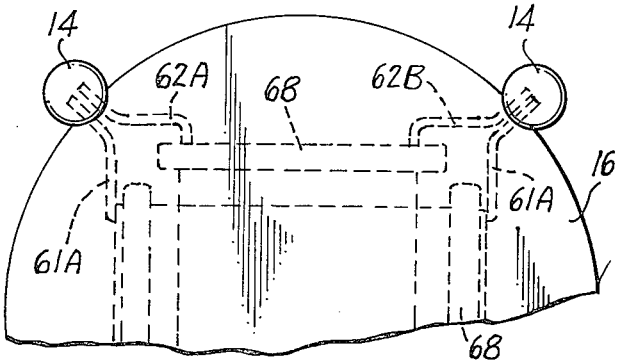

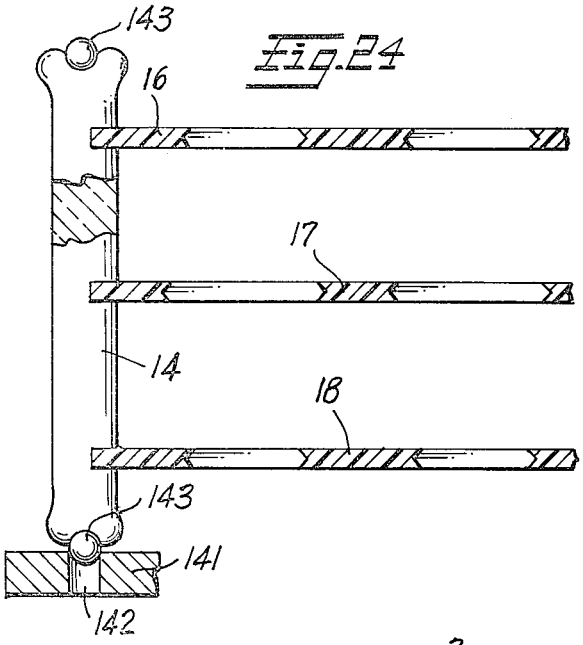
Fig. 24
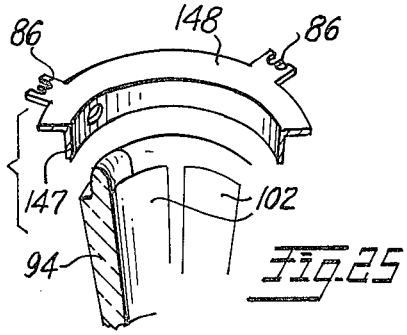
Fig. 25
Fig. 26
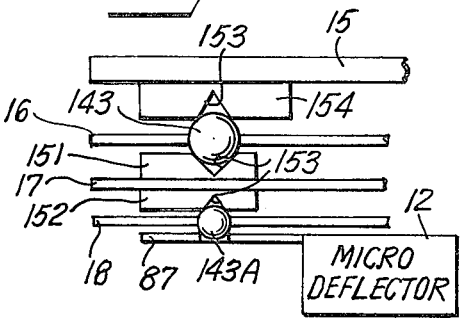
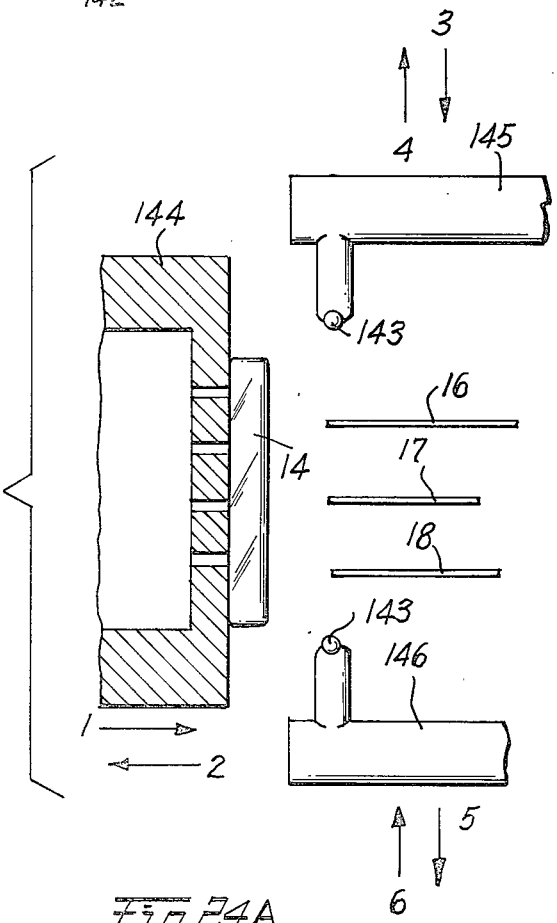
Fig. 24A
Fig. 26A
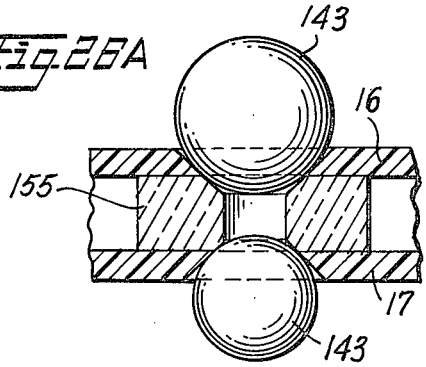
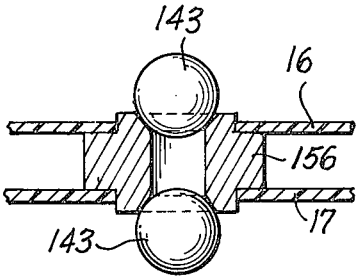
Fig. 26B Fig. 28A
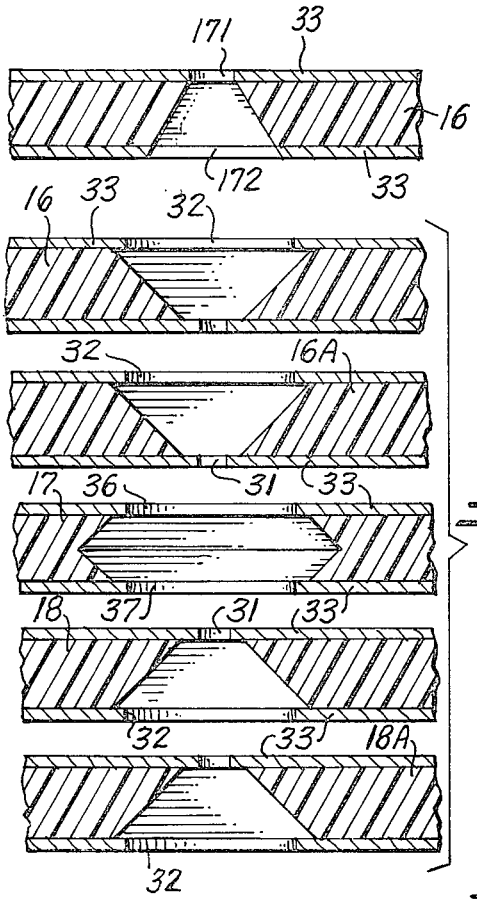
Fig. 28
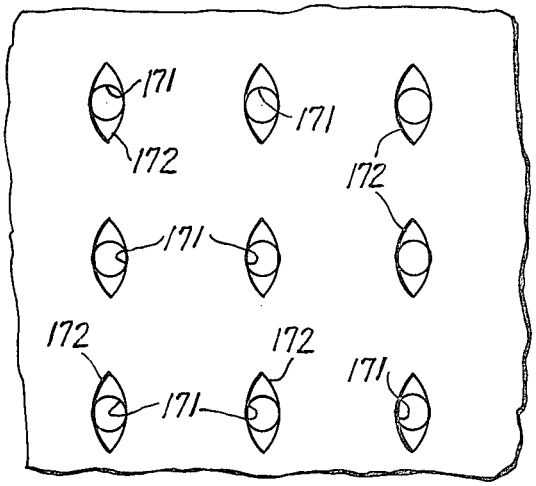
Fig. 29
Fig. 30
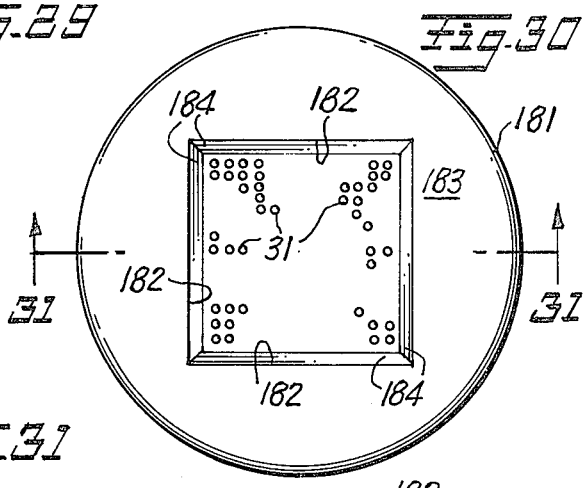
Fig. 31
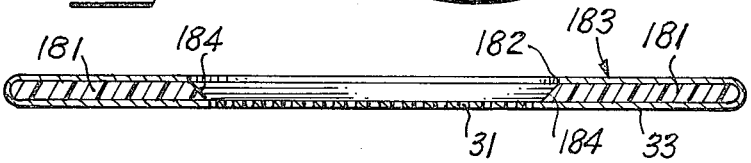
Fig. 27
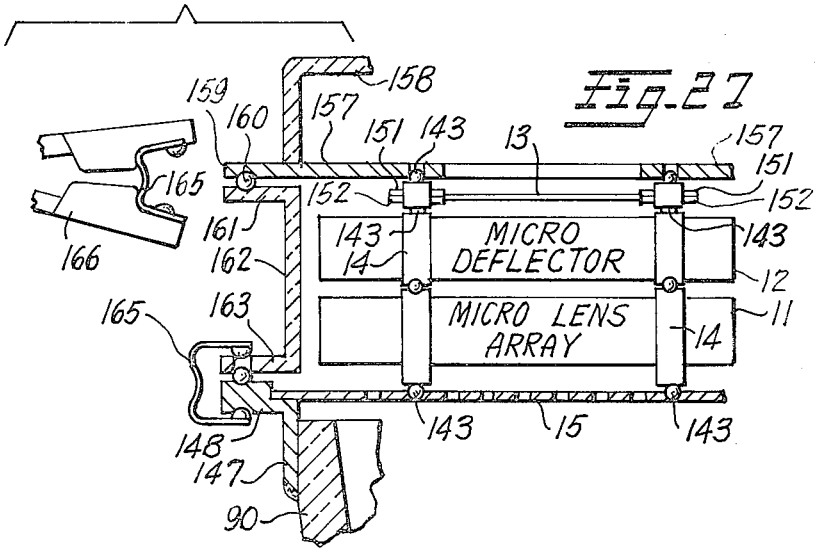

MICRO LENS ARRAY AND MICRO DEFLECTOR ASSEMBLY FOR FLY'S EYE ELECTRON BEAM TUBES USING SILICON COMPONENTS AND TECHNIQUES OF FABRICATION AND ASSEMBLY

BACKGROUND OF THE INVENTION

1. Field of the Invention

This invention relates to a new and improved micro lens array and micro deflector sub-assembly fabricated from silicon semiconductor plates processed in accordance with semiconductor microcircuit fabrication technology, metalized in part and held together in assembled relationship by glass rodding to which the silicon plates are used or otherwise secured either directly or through the medium of suitable metal mounting rings.

2. Prior Art Problem

The desirability of using a matrix of micro-electron optical elements arranged in the manner of a fly's eye lens is a now well-established fact in that such an arrangement provides large field coverage without sacrifice of resolution, large beam current, deflection sensitivity or accuracy and other desirable attributes as described in a paper entitled "Electron Beam Memories" by D. E. Speliotis, D. O. Smith, K. J. Harte and F. O. Arntz, presented at the ELECTRO/76 held at Bostom, Mass. on May 11–14, 1976 and in an article entitled "Advances in Fly's Eye Electron Optics" appearing in the Proceedings of the National Electronics Conference, vol. 23, pgs. 746–751 (1967) by S. P. Newberry et al. While the desirable characteristics of the fly's eye electron optical system are well established, as the requirements for the number of channels in the matrix increases and the linear dimensions of the matrix correspondingly decrease in efforts to increase its storage capacity and minimize the size, complexity and weight of the equipment, the problems of fabrication of fly's eye electron beam systems using known materials and fabrication techniques become increasingly difficult if not insurmountable.

In the known prior art fly's eye electron optics system heretofore available to the art as described in the above-noted National Electronics Conf. article, the micro lens array sub-assembly has been fabricated in the form of a "top hat" structure as shown in FIG. 2 of the article. In this form of micro lens array, the focusing element of the micro lens consists of an array of holes formed in thin metal plates. The thin metal plates in turn are tightly stretched and bonded to a strong metal ring and the holes are produced by a variety of methods such as drilling, punching and photo-chemical etching to mention a few. The problems encountered with these known micro lens array structures are:

(1) Photo-chemical etching of metal is expensive and does not result in lens aperture openings having required roundness, smoothness and uniformity between holes in the array.

(2) While punching of holes does reduce cost substantially, and if followed by a finishing operation such as shaving, does produce uniform diameters and smooth surfaces, these procedures cannot be accomplished on a matrix of holes (lens aperture openings) in which the hole diameter equals or even approaches the optimum ratio to the spacing between holes.

(3) The use of heavy metal rings to support the thin plates does not permit close spacing of the plates as the spacing between lens aperture openings (channels) is decreased to optimize density of channels and minimize size. If the "top hat" structure shown in FIG. 2 of the National Electronics Conference article is employed, while permitting close spacing between lens plates, it is expensive and uses space inefficiently, but most seriously, it prevents close approach to one side of the lens elements of neighboring elements of the overall fly's eye electron optical system.

(4) If an attempt is made to avoid the above-discussed difficulties encountered with the use of thick mounting rings or the "top hat" configuration by using metal plates which are thick enough to be self-supporting, eventually the impossible condition would be reached in large arrays (e.g., arrays having lens elements numbering $128 \times 128$) where the plate thickness required for mechanical rigidity exceeds the spacing between the plates required for optimum electron optical performance. Additionally, thick plates are more costly to process in the fabrication of the lens aperture openings (holes), are more severely limited in hole size permitted, and are inclined to warp during bake-out temperature cycling due to built-up strains. Finally, as with thin metals, the desired optimum hole diameter to spacing between holes cannot be achieved.

Turning attention now to the micro deflector structure for achieving fine deflection, the above-mentioned National Electronics Conference article describes a micro deflector construction which has been successfully applied to the fly's eye lens and comprises two sets of parallel conductive bars in tandem. The use of metal plates to produce the deflection bars has not been satisfactory, however, for reasons to be discussed hereafter. Sawing of bars from ceramic blocks and metalization of the ceramic bars, has produced electron optically acceptable fine deflectors but the cost has been unacceptable and the yield very low. In summary, experience with the known fine deflector sub-assembly design has taught the following lessons:

(1) Micro deflector systems which depend upon production of individual deflector plates which are subsequently stacked together with spacers require unreasonable tolerance control because the position error is cumulative. Single blade metal deflectors are better than metal deflectors sawed from solid stock, but they are expensive and too thin to remain straight unless placed in tension by the assembly.

(2) Thin metal plates are microphonic at some resonant frequency and this resonance can be excited by the application of periodic changes in the deflection voltage such as a raster scan.

(3) In micro deflector systems which use deflector bars sawed from blocks, the ceramic blocks must be sawed in the fired state (i.e., very hard) in which state they are so abrasive that even diamond tools wear rapidly and the dimensions are very difficult to hold. Thus, they are costly to produce.

In addition to the component fabrication problems discussed above, the overall structure, i.e., the micro lens array plus micro deflector and target electrode member, has further constraints. Since a single piece of dirt can spoil an assembly for many applications, the assembled structure must either be capable of disassembly for cleaning or fabricated by techniques which leave it electron optically clean. Additionally, the assembly must not permit relative motion of the parts by environmental factors such as vibration or thermal excursions. Two of the most important applications for fly's eye type electron beam tubes are in electron beam accessed semiconductor target memories for use with computers and in microcircuit pattern fabrication. In these applications, if the target area covered is large, then temperature excursions pose a severe problem with the mixing of construction materials such as metals, ceramics and semiconductor targets each with a different temperature coefficient of expansion and pattern displacement of several microns can occur due to normal room temperature variations. Thus, it will be appreciated that the above-listed requirements can make the overall assembly of a fly's eye electron beam tube micro lens array and micro deflector a very difficult problem.

From the foregoing discussion, it would be appreciated that new materials and methods of construction of micro lens arrays and micro deflector sub-assemblies are required if the benefit of higher density, larger arrays are to be achieved for the industry.

SUMMARY OF THE INVENTION

It is therefore a primary object of the present invention to provide a new and improved micro lens array and micro deflector sub-assembly for use in electron beam tubes of the fly's eye type and which is fabricated from silicon, either in single crystal or polycrystalline form, to the greatest extent possible and wherein certain parts are processed in accordance with silicon semiconductor microcircuit fabrication techniques and other parts of which are metallized and the various parts held together in an assembled structure by glass rodding. The advantages obtained by fabricating the fly's eye electron optical assembly from silicon in this manner are:

(1) In electron beam accessed memories, thermal match is obtained between the recording media and the micro lens array and micro deflector elements since such elements are formed of silicon and glass rodding which has a temperature coefficient of expansion very near to that of silicon.

(2) The high purity and regularity of the material (single crystal silicon) permits construction of the micro lens elements by known microcircuit photoetch techniques and better quality holes and straighter edges are obtained in comparison to holes formed in metals or amorphous materials.

(3) Fewer problems are encountered with the flatness of the materials.

(4) It is not necessary to mount the micro lens plates on a supporting ring of substantial thickness thereby permitting closer spacing between the micro lens plates.

(5) As will be explained more fully hereafter, it is possible by appropriate fabrication techniques to make bi-layer lens elements without bimetallic thermal effects thus permitting the construction of highly conductive, buttressed outer lens plates having ultra thin lens aperture openings formed on a silicon lens plate of substantial thickness and conductive layers on each of the opposite sides thereof.

(6) Metalization (if needed) and bonding techniques for silicon plates are well established and proven.

(7) Extreme cleanliness and stability at bake-out can be obtained for the resulting structure.

(8) Polycrystalline silicon is easier to saw and metalize than ceramic thus making the problem of micro deflector bar fabrication much less costly and better controlled.

(9) In addition to producing smoother more uniform lens aperture openings (holes) in silicon plates, the photochemical etching techniques used in producing the holes permit hole size to center spacing to be controlled to optimum values.

In practicing the invention a combined fine focusing micro lens array and micro deflector sub-assembly is provided for use in electron beam tubes of the fly's eye type. The assembly comprises a fine focusing micro lens array sub-assembly formed by a plurality of spaced-apart, stacked, parallel, thin, planar, apertured lens plates each fabricated from silicon semiconductor material and having an array of micro lens aperture openings formed therein by photolithographic semiconductor microcircuit fabrication techniques. The apertured silicon lens plates each have highly conductive surfaces and are secured to glass rods for holding the plates in stacked, parallel, spaced-apart relationship with the longitudinal axes of the glass support rods extending at right angles to the planes of the silicon plates. The apertures in all of the silicon lens plates are axially aligned in parallel with a longitudinal axis passing through the center of the array to form an array of fine focusing lens elements. The assembly further includes a micro deflector sub-assembly mounted immediately adjacent to the fine focusing micro lens array and defining a honeycomb matrix of sets of orthogonally disposed micro deflector elements, there being a set of orthogonally disposed micro deflector elements axially aligned with each respective fine focusing lens element formed by the axially aligned aperture openings of the stacked parallel spaced-apart silicon lens plates for deflecting an electron beam passing through a respective axially aligned fine focusing micro lens array element along orthonal x-y directional axes of movement in the plane normal to the electron beam path. The honey-comb matrix of sets of micro deflector elements are comprised by two orthogonally arrayed sets of parallel, spaced-apart deflector bars which define the respective orthogonally arrayed sets of micro deflector elements with alternate bars of each set of deflector bars being interconnected electrically for common connection to a respective source of fine x-y deflection potential. In one preferred embodiment, the thin planar apertured lens plates comprise a thin planar wafer of single crystalline silicon about 2 microns thick and having a matrix of lens aperture openings formed therein by etching from one side only all the way through the thickness of the wafer. In a second preferred embodiment, the thin planar apertured lens elements each comprise a thin planar single silicon wafer of about ½ millimeter in thickness etched from each of the opposite planar sides thereof through openings defined by a masking area formed on both planar surfaces of the wafer where no openings are to be formed and application of a suitable etchant to both sides of the wafer.

In preferred embodiments, the deflector bars of the micro deflector sub-assembly are fabricated from polycrystalline silicon having metalized surfaces. The two orthogonally arrayed sets of parallel, spaced-apart deflection bars are held in assembled spaced-apart, parallel relationship by respective sets of supporting glass rods whose longitudinal axes extend in a plane parallel to the plane of the deflector bars but at right angles thereto and to which the ends of the deflector bars are fused.

In one preferred embodiment, the micro lens array sub-assembly and the micro deflector sub-assembly have the glass support rods thereof thermally bonded to respective, annularly shaped outer support rings comprised of molybdenum, tungsten or other suitable metal and having alignment notches formed around the periphery thereof for facilitating alignment of the respective sub-assemblies. The outer support rings in turn then are thermally bonded to an additional set of glass support rods whose longitudinal axis extend at right angles to the planes of the apertured silicon plates and to the plane of the deflector bars for holding the two sub-assemblies in assembled relationship.

In another preferred embodiment, the thin apertured silicon lens plates are thermally bonded directly to a set of glass support rods whose longitudinal axis extends at right angles to the planes of the lens plates and to which the support rods for the micro deflector bars also are thermally bonded.

The micro deflector sub-assembly further comprises end deflector bars which have extensions of malleable metal material extending beyond the points of connection of the ends of the end deflector bars for use as mounting tabs either to the outer support ring, or directly to the glass support rods which extend at right angles to the plane of the micro deflector bars. In structures which do not employ the outer support rings having alignment notches, alignment of the micro deflector elements is obtained by light optical or electron optical alignment techniques and fusion of the various silicon elements to the glass support rods can be obtained by electron beam heating or laser beam heating and fusion jointure. In assemblies where bonding rings are not employed, the set of glass support rods to which both the micro lens array and the micro deflector sub-assemblies are secured, have the ends thereof shaped to seat with and be fused to a precision insulating sapphire ball that is in turn seated in and fused to a socket formed in an annularly shaped supporting ring for mounting the assembly within the housing of a fly's eye type electron beam tube. The structure thus comprised also has a target electrode member fabricated from silicon semiconductor material mounted in parallel to the micro lens array and micro deflector bar but spaced therefrom and secured by fusion to the common glass support rods.

Electrical connection to at least one of the thin apertured silicon lens plates of the micro lens array sub-assembly is obtained by trapping an exposed portion of a conductive wire between the hot glass of at least one of the glass support rods and the conductive surface of the respective plate during thermal bonding or fusion of the plates to the glass support rods. The conductive wire thereafter may be connected by conventional lead-in insulated conductor to a source of electric energy.

In another preferred embodiment, the glass support rods at the point of thermal bonding to the silicon lens plates have projections formed thereon extending inwardly to contact the peripheral edge portions of the silicon plates at the point of fusion to thereby provide greater effective insulator distance between adjacent silicon plates while maintaining minimum physical spacing or plate separation distance between the plates. If desired, the lens aperture openings formed in at least one of the thin apertured silicon lens plates need not be round but may be semi-elliptical or of another configuration for reducing third order aberrations.

In embodiments wherein because of the intended application it may be necessary to disassemble the assembly from time to time, ring-shaped metal pads of compatible conductive material are brazed or otherwise secured to points around the peripheral edge of the thin silicon apertured lens plates for increasing the thickness thereof and a plurality of insulating ball spaces are seated in the ring-shaped metal pads for assembling the thin silicon plates in a stacked, spaced-apart, parallel array upon being clamped together in a self-supporting structure. Alternatively, a plurality of support holes may be formed around the peripheral edge portion of at least one of the thin silicon apertured lens plates and a plurality of small insulating ball spacers seated in and fused to the holes for providing an insulating mounting means for the respective thin silicon lens plates and insulating balls.

The combined micro lens array and micro deflector assembly thus comprised may be used with a planar target electrode member of silicon semiconductor material for an electron beam accessed memory, mounted in common with the assembly in a vacuum-tight housing or alternatively may be used with a target member of electron sensitive material (such as a photosensitive target or an electron etchable photo resist target member used in the fabrication of microcircuits) removably mounted by a vacuum-tight enclosure in common with an in a plane parallel to the thin apertured micro lens silicon plates and the plane of the micro deflector bars. With either type of application, the assembly may be used with a coarse deflector electrode system or alternatively with a graded field electrode system located intermediate the electron gun of the electron beam tube and the fly's eye electron optical system thereby allowing the new and improved fly's eye electron optical system to be used either with a coarse deflected beam of electrons, or a uniform flood of electrons.

BRIEF DESCRIPTION OF THE DRAWINGS

These and other objects, features and attendant advantages of the invention will become better understood after a reading of the following detailed description considered in connection with the accompanying drawings wherein like parts in each of the several figures are identified with the same reference number, and wherein:

FIG. 9 is a longitudinal sectional view of a fly's eye electron beam tube showing the novel micro lens array and micro deflector assembly constructed in accordance to the invention used in conjunction with an electron sensitive target member which may be either photosensitive or may comprise a target member having an electron sensitive photo resist or other type of surface that can be selectively etched by an electron beam in the fabrication of semiconductor integrated microcircuits and the like, and where the fly's eye electron beam tube is of the type employing a coarse deflector structure for selectively supplying an electron beam tube through selected ones of the micro lens and micro deflector elements sequentially;

FIG. 12 is an end view of the alternative micro lens array and micro deflector assembly shown in FIG. 11;

FIG. 13 is a longitudinal side view of the micro lens array sub-assembly only comprising a part of the assembly shown in FIGS. 11 and 12;

FIG. 14 is an end plan view of the micro lens array sub-assembly shown in FIG. 13 as viewed from the electron beam entrance side thereof;

FIG. 15 is an end plan view of the micro deflector sub-assembly only used in the assembly shown in FIGS. 11 and 12;

FIG. 16 is a longitudinal side view shown partly in section of the micro deflector sub-assembly shown in FIG. 15;

FIG. 17 is a series of cross-sectional views taken through a typical set of aligned lens aperture elements such as the micro lens array sub-assemblies shown either in FIGS. 3 and 4 or FIGS. 13 and 14 illustrating details of the construction thereof;

FIGS. 20 and 20A–20F illustrate a series of fabrication steps starting with an essentially flat box-shaped block of silicon for constructing the preferred form of micro deflector sub-assembly according to the invention;

FIGS. 21 and 21A are schematic illustrations of a preferred form of micro lens array and micro deflector sub-assembly employing all silicon lens plates, deflector bars and target member and using only glass support rods without requiring metal mounting rings as a part of the electron optical assembly;

FIGS. 22 and 22A show alternative forms of construction for the glass support rods whereby the length of insulator between adjacent plates of the micro lens array can be considerably increased without requiring that the spacing distance between the plates be increased;

FIGS. 23 and 23A show a preferred assembly technique and construction for the metalized silicon bars or blades of the micro deflector sub-assembly which does not require the use of metal end deflector bars;

FIGS. 24 and 24A illustrate the manner in which an all glass and silicon micro lens array and micro deflector assembly such as shown in FIG. 21 can be assembled together for securement within the evacuated housing of a fly's eye electron beam tube, the assembly being achieved with insulating sapphire balls which are heat pressed and or thermally bonded to the ends of the glass support rods in the manner depicted in FIG. 24A and seated in holes formed in suitable support rings;

FIG. 25 is a schematic illustration of a preferred technique for mounting a metal supporting ring in the form of a collar, shrink fitted band or housekeeper's seal around the periphery of a coarse deflector cone for use in supporting array assemblies according to the invention on such cones;

FIGS. 26, 26A and 26B are schematic illustrations of alternative techniques of assembly for securing all glass and silicon micro lens array and micro deflector assemblies constructed according to the invention together for mounting within the evacuated housing of a fly's eye electron beam tube whereby the resultant assembly may be subsequently readily disassembled without requiring breakage of parts for realignment, for use with electron sensitive photo resist target members, etc. employed during micro-circuit fabrication or the like using such electron beam tubes;

FIG. 27 is a partial sectional view of another form of micro lens array and deflector assembly according to the invention wherein the micro lens plates and micro deflector are assembled with small sapphire balls seated within holes, sockets and/or spacer elements and clamped together for subsequent easy breakdown and reassembly;

FIG. 28 and 28A is a plan view and a sectional view respectively of a micro lens plate having specially designed shapes for the lens apertures fabricated according to the invention for electron beam aberration correction purposes;

FIG.29 is a series of cross-sectional views of still another embodiment of micro lens array sub-assembly according to the invention where five etched semiconductor plates comprise the array;

FIG. 30 is a plan view of still another form of etched silicon semiconductor micro lens array plate according to the invention wherein extremely thin lens plates of the order of 2 microns ($2\mu$) in thickness are provided; and FIG. 31 is a cross-sectional view taken through plane 31—31 of FIG. 30 of the extremely thin micro lens array plate shown in FIG. 30.

DETAILED DESCRIPTION OF PREFERRED EMBODIMENTS

Figure 2:
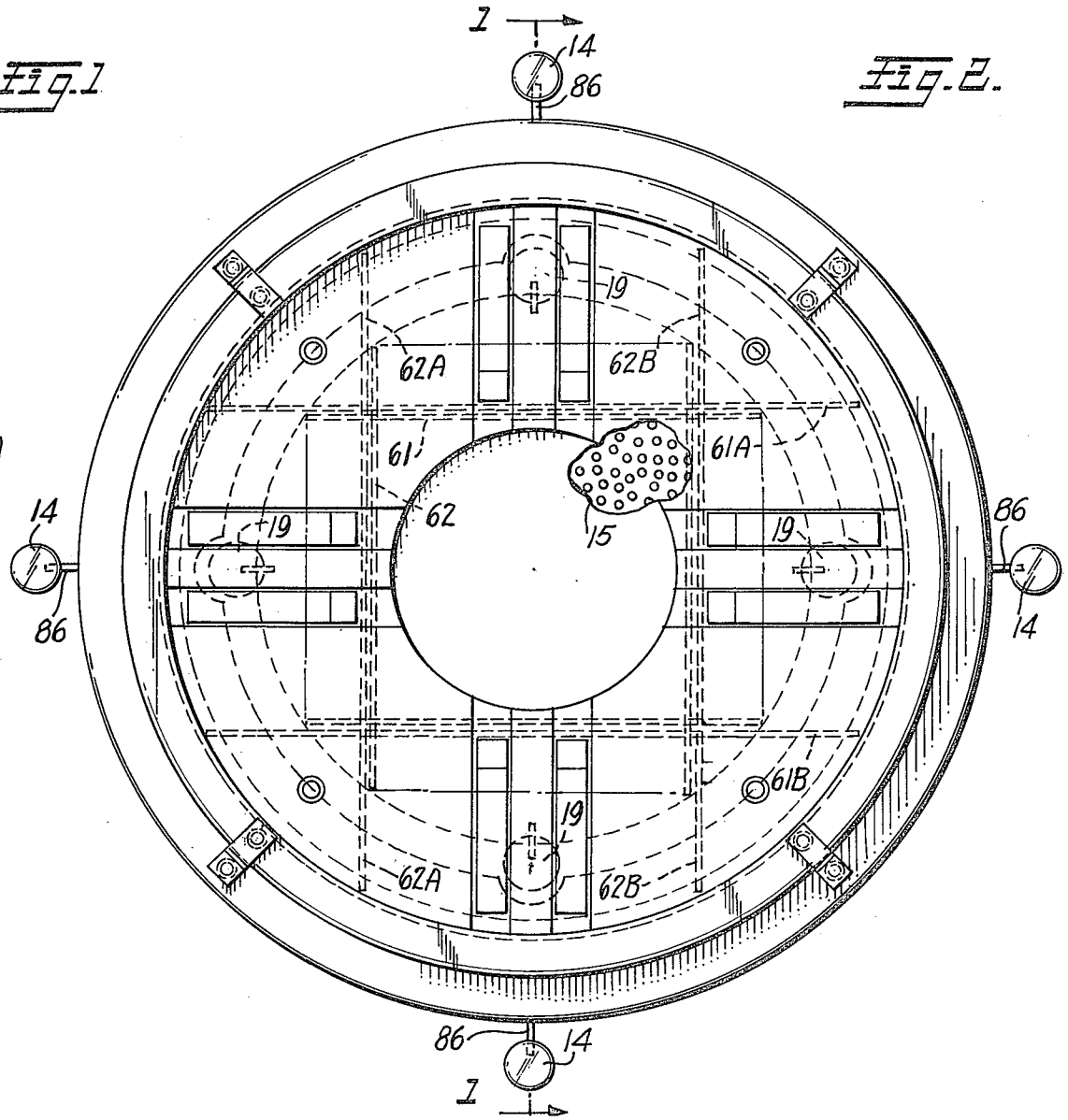
FIG. 2 is an end view of the micro lens array and micro deflector assembly shown in FIG. 1 looking through the entrance end thereof relative to an electron beam passing through the assembly, with the longitudinal sectional view shown in FIG. 1 being taken through plane 1—1 of FIG. 2.
Figure 1:
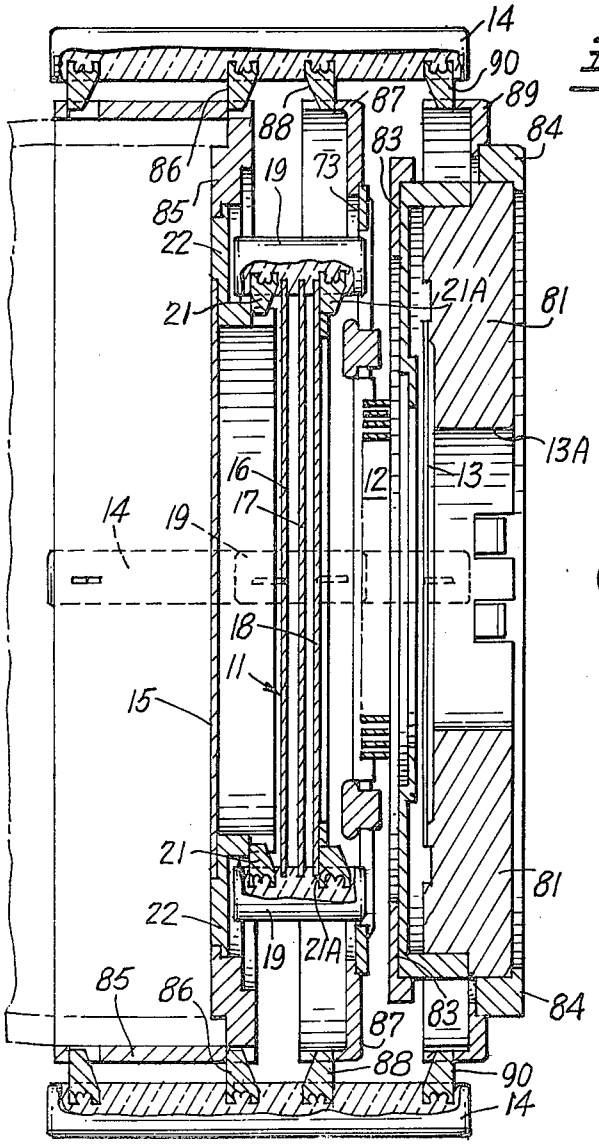
FIG. 1 is a longitudinal sectional view of a new and improved micro lens array and micro deflector assembly for fly's eye electron beam tubes using silicon micro lens elements and micro deflector plates and constructed according to the invention.

FIG. 1 is a sectional view taken through plane 1—1 of FIG. 2 of a preferred form of micro lens array and micro deflector assembly according to the invention. As shown in FIGS. 1 and 2, the assembly is comprised by a micro lens array sub-assembly shown generally at 11, a micro deflector sub-assembly 12, a target assembly shown generally at 13, and a plurality of elongated glass support rods two of which are shown at 14 and all of which extend at substantially right angles to the plane of the micro lens array plates comprising the micro lens array sub-assembly and the plane of the micro deflection bars comprising the micro deflector assembly. In addition, the assembly further includes a termination plate shown at 15 which comprises a part of the micro lens array sub-assembly as will be explained more fully hereafter.

Figure 4:
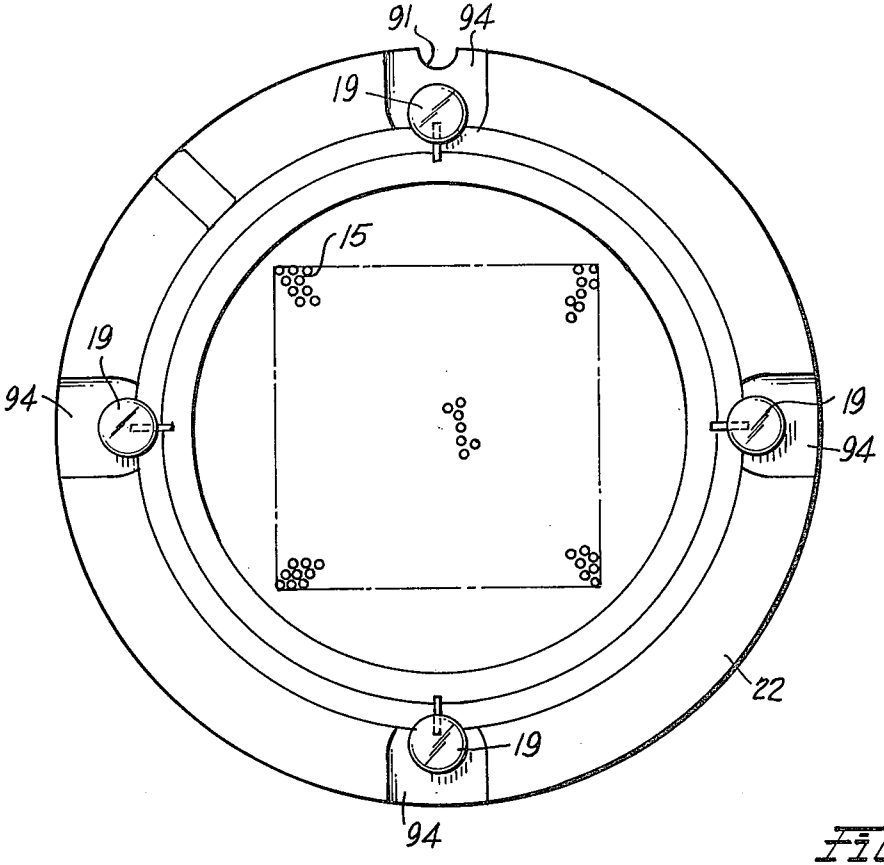
FIG. 4 is an end view of the micro lens array sub-assembly shown in FIG. 3.
Figure 3:
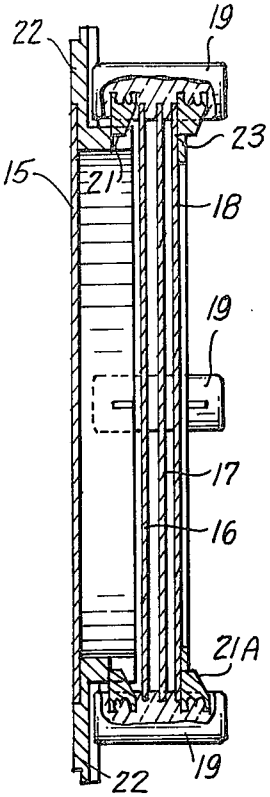
FIG. 3 is a longitudinal sectional view of a micro lens array sub-assembly constructed according to the invention and comprising a part of the assembly shown in FIG. 1.
Figure 19:
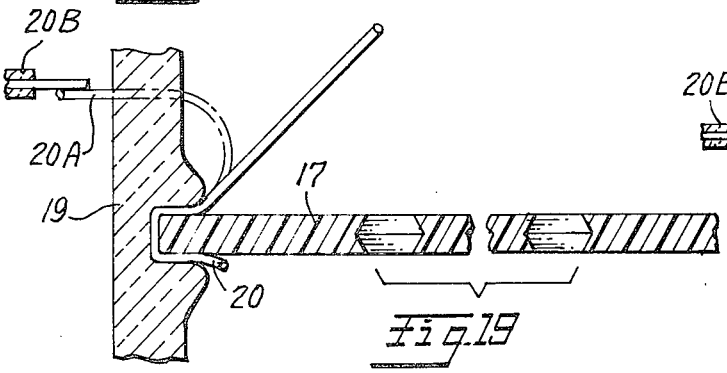
FIG. 19 is a partial cross-sectional view illustrating the manner of securement of a thin silicon plate micro lens array element to a supporting glass rod and in addition illustrates the manner in which a thin, preferably flat, conductive wire is trapped between the ends of the conductive surface of the thin flat silicon plate and the glass support rod to which it is thermally bonded, whereby a desired electric excitation potential may be applied to the silicon plate.
Figure 19A:
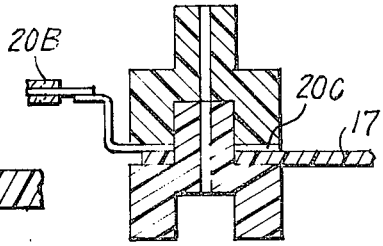
FIG. 19A illustrates an alternative form of glass rod support made up of a stack of off-set type glass washer elements and wherein a thin metallic washer and interconnected lead-in conductor can be employed to apply desired electric excitation potentials to the thin silicon plate trapped between the glass support washer elements.

The construction of the micro lens array sub-assembly is best seen in FIG. 3 and FIG. 4 of the drawings wherein it is shown in FIG. 3 that the micro lens array is comprised essentially of a plurality of three (3) (but could be four (4), five (5) or more or less such as 2 or one as needed for a particular application) of spaced-apart, stacked, parallel, thin, planar, apertured lens plates 16, 17 and 18 each of which is fabricated from silicon semiconductor material which preferably is single crystal silicon. As will be described more fully hereafter, each of the thin apertured silicon lens plates has an array of micro lens aperture openings formed therein by photo-lithographic semiconductor microcircuit fabrication techniques with the remaining surfaces of the plates being highly conductive. The apertured silicon lens plates 16, 17 and 18 are secured by thermal bonding or otherwise to glass support rods 19 arrayed around their outer periphery for holding the lens plates in stacked, parallel, spaced-apart relationship. While securing the lens plates 16, 17 and 18 in assembled relationship on the glass support rods 19, the lens aperture openings in all of the silicon lens plates are axially aligned along longitudinal axes passing through the center of each aperture opening and which are at right angles to the plane of the plates. This is achieved by means of alignment notches formed in the starting silicon wafers from which the apertured lens plates are fabricated in a manner to be described more fully hereafter or alternatively may be achieved by means of electron optical or light optical alignment techniques. Axial alignment of the lens aperture openings in each of the respective thin silicon plates 16, 17 and 18 commences with the placement of photo resist patterns employed in forming the aperture openings on the starting thin silicon wafers and are used right on through to assembly of the several lens plates together onto the supporting glass rods 19. In mounting the thin silicon plates to the glass support rods, the peripheral edge portions of the thin silicon plates are thermally bonded onto the glass rods by heating the glass rods to substantially their melting point. At the temperature where the glass rods commence to soften, the rod is phsically pressed into the periphery of the stacked and aligned plates supported in a suitable holding fixture with the array of aperture openings therein axially aligned as described above and thereafter the glass rod is allowed to cool. Different electrical excitation potentials are supplied to the thin silicon plates in the manner best shown in FIGS. 19 and 19A of the drawings. In FIG. 19 it will be seen that a small conductive wire such as nichrome has one exposed end shown at 20 trapped between the edge of the thin silicon plate 17 and the supporting glass rod 19 during thermal bonding. The remaining end of wire 20 is bent over as shown by dotted lines at 20A to connect to the exposed end of a conventional insulated lead-in conductor 20B for the excitation potential to be applied to plate 17. In FIG. 19A a small nichrome washer 20C that contacts the outer conductive surface of plate 17 is seated between a pair of nesting, coaxially aligned, glass rod insulator segments having two different diameter, cylindrically-shaped end portions. By clamping a suitable number of such insulator segments together and tailoring their longitudinal extent, proper spacing between the lens plates can be obtained. By thus assembling the micro lens array, the respective thin apertured silicon lens plates 16, 17 and 18 (which may have a thickness of the order of ½ millimeter in thickness and are spaced-apart approximately one and one-half millimeters) are capable of sustaining a voltage difference between plates of the order of 5 to 10 kilovolts without breakdown and conduction between adjacent plates. In place of nichrome, a metal which alloys with silicon could be used to form the contacts 20 or 20C, thereby assuring secure electrical contact of the lead-in conductor to the thin silicon plates.

With the stacked, parallel apertured thin silicon plates comprising the lens array secured to the glass support rods 19 in the above described fashion, the glass support rods in turn are fastened by suitable mounting tabs shown at 21 to an annularly-shaped outer support ring 22 which also supports the termination plate 15. The mounting tabs 21 are generally trapezoidal in configuration as shown and have an essentially half-heart shaped depression formed in the end thereof for engaging the glass support rods to assure permanent and solid securement to the glass support rods after cooling. Placement of the mounting tabs 21 in the glass support rods may of course take place concurrently with the securement of the thin apertured silicon plates 16–18 to avoid the necessity for thermal recycling of the glass support rods in two different operations, however, in advance of securing the mounting tabs 21 to the glass rods, the mounting tabs are first brazed, or otherwise secured to the annularly-shaped, support rings 22 which may be formed from molybdenum, tungstem, or other suitable metal for providing electron optically clean surfaces after bake-out within an evacuated housing enclosure.

The construction and purpose of the termination plate 15 is described more fully in a paper entitled "Computer-Aided Design and Experimental Investigation of an Electron-Optical Collimating Lens" by C. T. Wang, K. J. Harte, N. Curland, R. K. Likuski and E. C. Dougherty appearing in the Journal of the Vacuum Society Technology, Vol. 10, no. 6, November/December 1973, pages 110–113. Briefly, it can be stated that the termination plate 15, sometimes referred to as "tuning plate" serves to terminate electric fields employed in the coarse deflection section of the fly's eye type electron beam so that such fields do not enter and adversely influence the behavior of the micro lens array and micro deflector assembly. Upon assembly of the micro lens array in a fly's eye electron beam tube, electron beams transiting the sub-assembly enter through the termination plate 15 and exit through the lens aperture openings of the last or uppermost silicon plate 18. Thus, plate 18 is physically disposed adjacent the micro deflector sub-assembly and may be subject to the influence of the relatively high frequency (of the order of megahertz or perhaps even gigahertz frequency) deflection potentials applied to the respective deflector plates of the micro deflector assembly. To assure that plate 18 remains rigid, a stiffening ring 23 of molybdenum, tungsten or other suitable compatible metal is secured to the outer periphery of the uppermost thin silicon plate 18 by means of the additional mounting tab 21A. For the best thermal match, stiffening ring 23 should be fabricated from polycrystalline silicon of sufficient thickness to provide the required stiffening.

As best shown in FIG. 17 of the drawings, lens aperture openings (hereinafter referred to as apertures) can be provided which are of exceptional symmetry (e.g., roundness) due primarily to the etching qualities of single crystal high purity silicon. By using boron diffusion patterns to provide sharp etching outlines in the silicon substrate, it is possible to provide these exceptional symmetry apertures in the lens plates for each set of axially aligned micro lens apertures, and to do so for the entire array of apertures to be formed in a single thin silicon wafer (e.g., 128 by 128 array of apertures) in a single processing operation. The sets of axially aligned apertures in the respective thin silicon lens plates 16, 17 and 18 are axially aligned with a respective set of micro deflector elements for any given channel. A channel is defined as an electron beam path provided by an axially aligned set of micro lens apertures and the coacting axially aligned micro deflector elements as described more fully hereinafter. A preferred axial profile for each axially aligned set of micro lens apertures defining any given channel is shown in FIG. 17. Referring to FIG. 17 it will be seen that each channel is comprised of four lens plates 16, 17, 18 and 18A. The fourth plate 18A may or may not be used depending upon the storage density desired. A very small aperture 31 of about 100 microns (100$\mu$) diameter is formed on the top surface of the top thin silicon aperture plate 16 on the electron beam entrance side of the assembly. This small aperture 31 is formed through a highly conductive surface portion 33 of the lens plate 16 that is produced as a result of the process in which the aperture 31 was formed. As stated above, because of the process and the manner in which it was formed (to be described hereafter) the aperture 31 is of exceptional symmetry about a central axis extending through the center of the aperture 31 and perpendicular to the planar surfaces of the thin silicon plate 16. A second or outlet aperture 32 likewise of exceptional symmetry and centered about the same central axis as aperture 31, is formed on the bottom surface of the lens plate 16 which also has a highly conductive surface area 34. Intermediate portions of the silicon wafer extending between the apertures 31 and 32 are etched back away a slight distance as shown at 35 in order to assure that only the highly conductive aperture sides 31 and 32 which are precisely formed and of exceptional evenness and symmetry are effective to produce an electric field that influences an electron beam passing through the lens element.

The second apertured thin silicon lens plate 17 has apertures 36 and 37 formed in the respective top and bottom surfaces thereof which are of substantially equal diameter and likewise are formed within highly conductive surface portions 33 and 34 of the thin silicon lens plate 17. In this plate, the outwardly sloping side surfaces 38 and 39 of each aperture project outward into the body of the semiconductor plate 17 from the respective apertures 36 and 37 and intersect at some mid-point spaced outwardly from the peripheral circumference of the equal diameter apertures 36 and 37 so as again not to influence the electron beam and assure that only the sides of the apertures 36 and 37 which are designed for that purpose, produce electric fields that affect the electron beam.

The third plate 18 of the stacked parallel lens plate has a larger diameter aperture 41 formed in its upper or electron beam entrance side in contrast to a very small diameter exit aperture 42 formed on its lower conductive surface portion 34. Here again, the sloping side surfaces 43 of the intervening silicon semiconductor body portion of plate 18 are etched a sufficient distance back away from the peripheral edges of the apertures 41 and 42 to assure that the intervening semiconductor of the silicon plate does not influence an electron beam passing therethrough. The last plate 18A in the array (if used) is identical in construction to the top plate 16. In assembling the stacked, parallel silicon lens plates 16, 17, 18 and 18A in the manner described previously, the respective longitudinal axis passing through the aperture 31 in lens plate 16 also constitutes the common axis for all of the axially aligned apertures further comprised by 32 in plate 16, 36 and 37 in plate 17, 41 and 42 in plate 18 and 31 and 32 in plate 18A (if used). Further, it should be kept in mind that an entire array of such axially aligned lens apertures are provided by the assembled micro lens plates wherein if there is a 128 by 128 matrix of lens elements provided in the array, FIG. 17 would have to be projected outwardly from each side to illustrate the additional 127 axially aligned lens elements arrayed along a single plane. Again, ideally, the center axis passing through each axially aligned set of array elements is parallel to all of the other center axes and all in turn are perpendicular to the plane of the thin silicon plates 16, 17, 18 and 18A, respectively.

The lens plates shown in FIG. 17 provide uniformity and exceptional symmetry in the placement of the small diameter lens apertures such as 31 and 42 in the small diameter regions of the axial profile shown in FIG. 17. It is also necessary that the plates 16, 17, 18 and 18A exhibit great rigidity because while in use they are in high field gradients and are thus subjected to strong deflection forces. The deflection forces can strongly influence the lens performance if the apertures do not possess a high degree of axial symmetry. This is due to the fact that the lens plates tend to deflect under the pull of the electric field applied between the plates so that the spacing of the lenslet elements near the center of the plate will be less than the spacing of the lenslet elements near the edges. To a first approximation, the spacing change does not cause any great disturbance since the stronger field created by the shorter distance in the center is in part offset by the shorter distance over which the field is applied. However, the outer lenslet elements experience a tilt as well as an infinitesimal radial displacement and this can cause some lens error of the type known as comma. For this reason, it is desirable that the plates be designed to deflect as little as possible upon being placed in operation. The axial profile shown in FIG. 17 permits a high stiffness or rigidity to weight ratio for optimum array densities versus center to center spacing of the lenslet elements thus providing a structure with a small mass which is required for use of the glass rodding assembly technique but which also possesses the required stiffness to prevent excessive deflection under electric field stress. By way of illustration, a silicon lens plate of approximately 3 inches in diameter and ½ millimeter thickness with a spacing between plates of about 1 millimeter, the total unbalanced forces on the plate are of the order of ½ lb. and the centered displacement is of the order of 50 micrometers (50μ) leading to a maximum tilt of less than ½ milliradian which gives an acceptable lens performance.

Figure 18A:
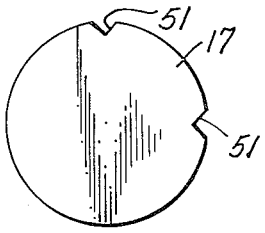
FIGS. 18A–18J illustrate a series of planar end views coupled with cross-sectional views of a starting single crystalline silicon wafer and shows the processing of the wafer required in the production of the apertured micro silicon lens plates employed in the micro lens array sub-assembly used in the embodiments of the invention shown in FIGS. 1–10 as well as the embodiment of the invention shown in FIGS. 11–17.
Figure 18B:
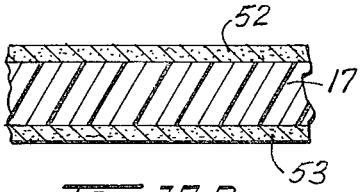
Figure 18C:
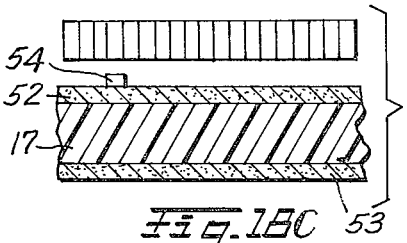
Figure 18D:
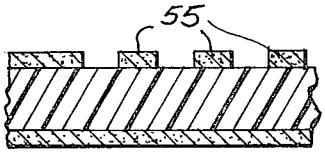

The required aperture profile can be provided by a variety of known photolithographic and etching techniques used in the fabrication of semiconductor microcircuits. A preferred technique for fabricating apertured micro lens array thin silicon plates is illustrated in FIGS. 18A through 18J. For starting material, an N-type single crystal silicon wafer 17 of approximately ½ millimeter thickness and 100 orientation shown at 17 is provided. Suitable alignment notches shown at 51 are cut into the periphery of the wafer to facilitate positioning of the photomasks employed in forming masking areas on the surface of the silicon wafer and also in subsequently aligning the wafer with other apertured lens plates used in the micro lens array. A wet silicon oxide layer then is grown on both sides of the silicon wafer as shown at 52 and 53 in FIG. 18B of the drawings. After growing the oxide layers on each side of the wafer, chromium alignment dots are formed on one surface at the outer edges by photolithography masking techniques and exposure of one surface of the wafer, such as 52, to a chromium vapor atmosphere to thereby produce the chromium alignment dots 54, as shown in FIG. 18C. Using the chromium alignment dots and the notches in the periphery of the wafer, and again using photolithography techniques, an array of silicon oxide dots are produced where apertures are to be formed in the wafer as shown at 55 in FIG. 18D. Each of the silicon oxide dots in the array should be of the same size and shape as the apertures to be formed in the wafer. After the oxide layer has been processed to form the oxide dots 55, the chromium alignment dots are removed. During this process the notches and back side of the wafer are protected with wax or other suitable protective coating.

The next step in the processing is to produce an array of oxide dots on the remaining untreated side of the wafer which, as shown in FIG. 17, may be of the same size or different size from the oxide dots formed on the previously treated side. If the wafer in question is being processed to produce an end plate, the oxide dots on the two sides of the wafer will be of different size but will have the same centers (e.g., axially aligned) as described previously. This is achieved using infrared techniques to assure alignment of the silicon oxide dots on both sides of the wafer during the photolithographic processing to produce the second set of oxide dots. The resultant array of oxide dots on the remaining surface are shown at 56 in FIG. 18E.

Figure 18E:
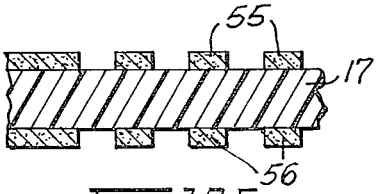
Figure 18F:
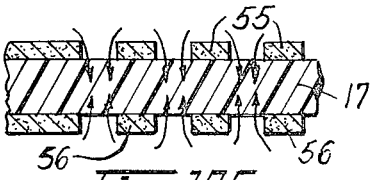
Figure 18G:
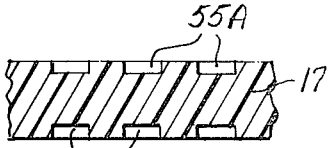
Figure 18H:
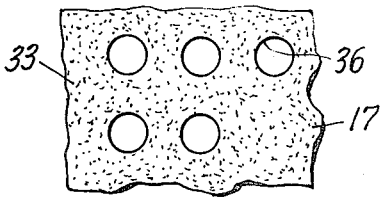
Figure 18I:
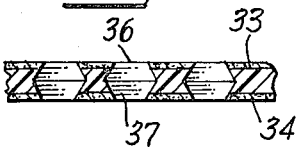
Figure 18J:
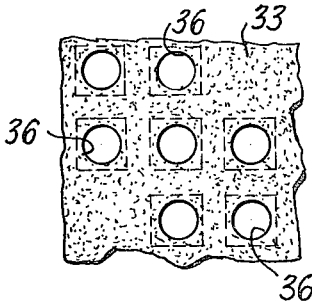

At this point in the processing, the wafer is spin coated with a boron containing emulsion with the emulsion being spin coated on both sides of the wafer. The boron containing emulsion coated wafer then is fired in a furance at about 1100° C. in a nitrogen atmosphere. During this processing, the boron dopant contained in the emulsion will diffuse into the surface of the silicon wafer to a depth of about 2 microns at which point the firing is discontinued as shown in FIG. 18F to result in a boron coated surface layer 33 where no apertures are to appear as best seen in FIG. 18H. The excess boron coating is removed in a hydrofluoric bath followed by a second bath in fresh hydrofluoric acid to remove the oxide buttons. This processing step leaves a deep and heavy boron layer formed in the surface areas of the wafer where it is desired that no apertures be formed and results in sharply defining the undoped silicon aperture opening areas as shown at 55A and 56A in FIG. 18G which are of quite even symmetry since the boron diffusion step is extremely uniform throughout. In a final processing step, the boron doped wafer is etched in a hot pyrocatechol and ethylene diamine bath as described in the article entitled "Ink Jet Printing Nozzle Arrays Etched in Silicon" by E. Bassous, et al. reported in Applied Physics Letters, Vol. 31, no. 2, July 15, 1977, pages 135–137, the teaching of which hereby expressly is incorporated. As taught in this article, the orientation rate dependence causes the etching action to stop when the sloping planes from under the two apertures being formed on opposite sides of the silicon wafer, meet. Consequently, the underlying silicon support for the apertures defined by the boron doped layer that now constitutes the remaining surface areas of the silicon wafer 17 is somewhat undercut below the boron doped layer 33 as shown in FIGS. 17, 18 and 18I to result in apertures of exceptional symmetry and evenness as depicted in FIGS. 18I and 18J of the drawings. In this respect, it should be noted that the profile of the silicon support underlying the thin boron doped layer 33 is not critical. The key factor is the thin surface boron doped layer 33 that defines the aperture (opening or hole) which must not be destroyed by the etchant used in etching away the silicon support intermediate the axially aligned aperture openings or each of the opposite sides of the silicon wafer. While there are a variety of ways known to the art for accomplishing differential etching action as described above, the preferred method is as disclosed.

The above description was with relation to the production of the center lens plate wherein the aperture openings on each side of the plate have substantially the same diameter. The technique described is not limited to fabrication of lens aperture plates of this type for it may also be used in fabricating the end plates wherein the aperture on one side of the plate is smaller than the aperture on the opposite side of the plate, as well as other configurations as depicted in FIG. 28.

Figure 6:
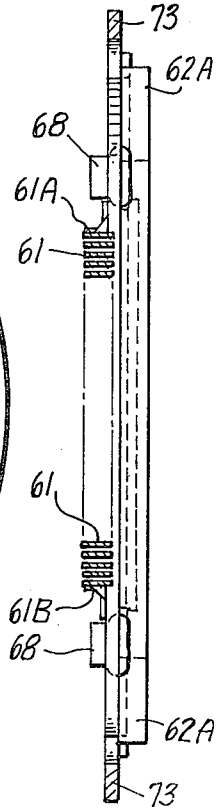
FIG. 6 is a longitudinal sectional view of the micro deflector sub-assembly shown in FIG. 5 and taken through plane 6—6 of FIG. 5.
Figure 5:
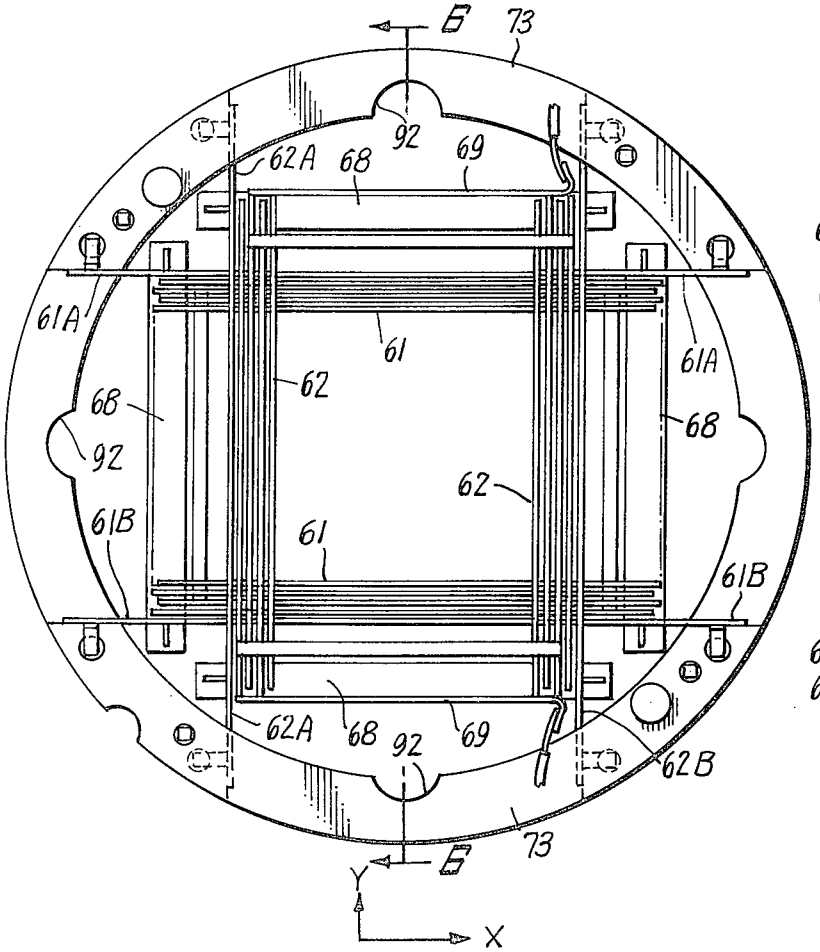
FIG. 5 is an end view of the micro deflector sub-assembly comprising a part of the overall assembly shown in FIGS. 1 and 2.
Figure 7:
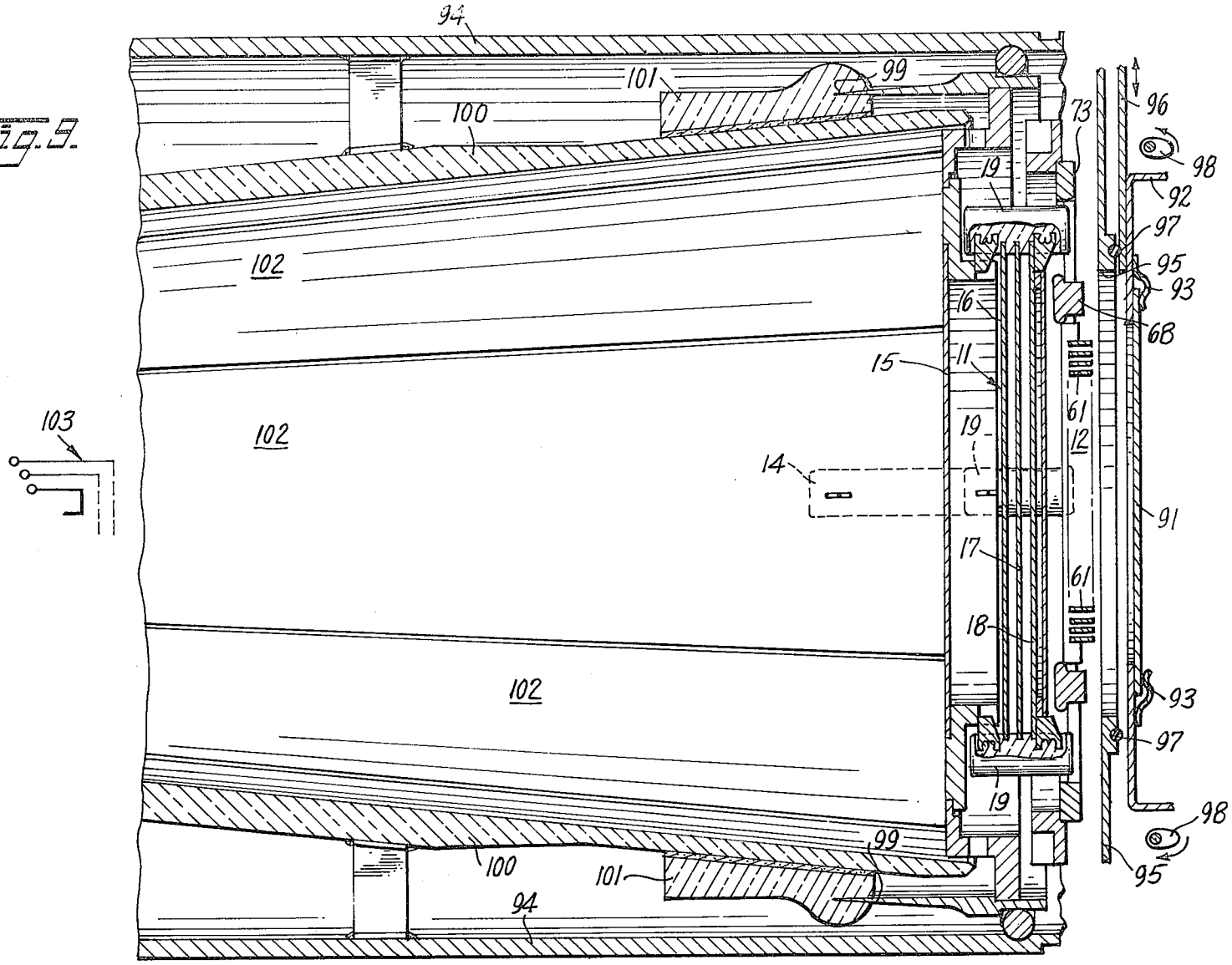

FIG. 5 is an end plan view of a micro deflector sub-assembly constructed in accordance with the invention and FIG. 6 is a partial cross-sectional view of the deflector sub-assembly taken through plane 6—6 of FIG. 5. As best seen in FIG. 5, the micro deflector sub-assembly comprises two orthogonally arrayed sets of parallel, spaced-apart, deflector bars 61 and 62 which are arrayed at right angles to each other so as to define a plurality of orthogonally arrayed sets of micro deflector elements. As will be described more fully hereafter, alternate ones of each set of orthogonally arrayed deflector bars 61 and 62 are electrically interconnected for common connection to a respective source of fine x-y deflection potential for deflecting an electron beam passing through any selected one of the micro deflector elements in a direction at substantially right angles to the path of the electron beam in either the x or y direction. For example, considering the x and y axis to be as indicated in FIG. 5, then the x axis deflection potential applied between alternate ones of the deflector bars 62 will cause an electron beam passing through any selected one of the micro deflector elements to be deflected right or left as viewed in FIG. 5 along the x axis depending upon the polarity and magnitude of the fine x deflection potential. Similarly, the fine y deflection potentials applied to alternate ones of the deflector bars 61 cause deflection of an electron beam passing through any selected one of the micro deflector elements along the y axis in a manner dependent upon the polarity and magnitude of the fine y deflection potentials applied to alternate ones of the deflector bars 61. Thus, it will be appreciated that the intersection of the orthogonally arrayed sets of deflector bars 61 and 62 at their points of intersection define an entire array of fine deflector elements since the deflector bars are spaced apart one from the other and at each intersection point of the orthogonally arrayed bars an essentially square-shaped, fine open space exists which defines the micro deflector element within the points of intersection. This micro deflector element or open space is arranged so that it is axially aligned with a corresponding set of micro lens aperture element formed in the micro lens array subassembly as previously described. For this purpose, extreme care must be taken when assembling the micro deflector sub-assembly with the micro lens sub-assembly as described hereafter in order to assure the proper axial alignment of each respective micro deflector element with its corresponding micro lens axially aligned aperture openings.

Each of the micro deflector bars 61 and 62 preferably is fabricated from polycrystalline silicon as will be described hereafter in connection with FIGS. 20, 20A through 20F and the surfaces thereof may be metalized with a platinum coating or other suitable highly conductive metallic material. As best seen in FIG. 20, the fine deflection bars 61, 62 preferably are sawed from a rectangular-shaped block 63 of polycrystalline silicon having grooves shown at 64 and 65 sawed or otherwise formed in each of the ends thereof. As best shown in the end view of FIG. 20A, the groove 64 is spaced from the end of the block of silicon 63 a greater distance "a" than is the groove 65 which is shown as being spaced a smaller distance "b" from the end of the block of polycrystalline silicon. The purpose for making the dimensions "a" and "b" different from one another will become apparent hereafter but it should be noted that the fine deflector bars 62 are fabricated in an identical manner and with essentially the same "a" and "b" dimension. Thus, after forming the grooves 64 and 65 in the block of polycrystalline silicon 63, the individual blades 61, 62 are sawed from block 63 in the manner indicated in FIG. 20. In contrast to aluminum oxide or other comparable ceramic, silicon is not nearly so hard so that tool wear in sawing the individual silicon deflector bars 61, 62 from the block of silicon is not a significant problem. At this point in the fabrication, the deflector bars 61, 62 are plated with about a 2000 Angstrom units thick coating of heavy metal such as platinum or gold preferably by an ion plating technique such as described in the article entitled "Electron Beam Techniques for Ion Plating" by D. Chambers and D. C. Charmichael reported in Research/Development, vol. 22, May 1971, or alternatively by vapor deposition as described in the article entitled "Physical Vapor Deposition" by Airco Temescal Staff (1976), R. J. Hill, Director (page 60). Other known metalization techniques and procedures also may be employed to provide the metal coating having good adherence and thickness of the order of about 2000 Angstrom units. Prior to metalizing the surfaces of the sawed deflector bars, it may be necessary to lap finish each of the bars to remove burrs and other surface irregularities prior to the metalization step.

FIGS. 20B and 20C are a plan view and side end view, respectively, of a suitable holding fixture for assembling the micro deflector plates together in a spaced-apart, parallel assemblage. In FIG. 20B, a square or rectangular block of silicon shown at 66 again is employed and has a plurality of slots such as shown at 67 cut therein to a suitable depth that will insure mechanical rigidity of holding action upon the respective metalized deflector bars fabricated as shown at 20 and 20A inserted therein in the manner indicated in FIG. 20C. The slotted silicon block 66 after fabrication forms a fixture that can be reused in assembling further micro deflector sub-assemblies as described hereinafter. Because it likewise is formed of silicon, it is thermally compatible with the blades which are being held by the fixture and hence will reduce or minimize stresses which might otherwise be encountered in the assemblage steps to be followed as described hereafter.

FIG. 20D shows a preferred procedure for assembling one set of the deflector blades such as 61 together in a parallel spaced-apart relationship by means of a glass supporting rod shown at 68. The metalized silicon bar or blades 61 (or 62) are held upside down in the slots 67 cut in the silicon holding fixture 66 with the grooves 64 and 65 facing upwardly and aligned along an axis looking into the plane of the paper. In so placing the blades, they are alternated end for end so that alternate bars have the groove 64 axially aligned with the grooves 65 in the remaining set of alternate bars. A glass support rod 68 then is placed in the axially aligned, alternate grooves 64 and 65 formed at each end of the parallel array of deflector bars as shown in FIG. 20D. A thin conductor wire or ribbon of platinum shown at 69 is then placed adjacent the elongated ends of alternate bars having the dimension "a" between the grooves 64 and the ends of the bars and a pressure pad 71 is applied to force the conductor wire 69 into positive engagement with the elongated ends of alternate ones of the blades 61. At the opposite side of the fixture, a similar arrangement is employed to bond a corresponding conductor wire 69 to the end of the remaining alternate sets of deflector bars 61. The fixture 66 is supported on a table of adequate strength and a second pressure pad indicated at 72 is applied downwardly across all of the deflector bars 61 to be assembled and concurrently heat is applied through a suitable heating tool to cause the glass support rods 68 to become heated to a temperature close to its melting point so that it softens and thermally bonds to the individual deflector bars at their points of contact with the glass support rod. Concurrently, heating current is supplied through the thin platinum conductor wire 69 to cause it to thermally bond to the ends of the metalized silicon bars and form good positive electric contact therewith. Upon cooling of the glass support rod 68, all of the deflector bars 61 will be thermally bonded to the glass support rods. Thereafter, the holding fixture 66 can be removed and used again in the assemblage of a second set of deflector bars. Because the holding fixture 66 is of the same material as the deflector bars, mechanical discrepancies and stresses due to thermal differences in the materials that might otherwise be built in during the heating and cooling phases of the assemblage operation, are avoided. A similar assemblage technique then is employed in mounting the second set of deflector bars 62 to their corresponding glass support rods thus resulting in the two sets of spaced-apart, parallel deflector bars 61 and 62 required to form the micro deflector sub-assembly first described with respect to FIGS. 1, 5 and 6 of the drawings.

FIG. 20D also illustrates schematically an alternative scheme for applying the required lead-in conductor wires to alternate deflector blades or bars and employing an alternative form of conductor wire 69A. The alternative conductor wire 69A can be circular in cross section, flat or any desired cross-sectional configuration since it is designed to fit into the groove 64 below the glass support rod 68 and extend along the top edges so as to contact and fuse to alternate blades or bars 62. For this purpose, it would be necessary to machine the two grooves 64 and 65 to different depths rather than different end displacements "a" and "b" and arrange them alternatively. The alternate conductor wire 69A then should have sufficient thickness to be engaged by and compressed somewhat by the glass support rod 68 upon being pressured into engagement with the sides of the groove 64 during thermal bonding of the glass support rod to the blades or bars 61. With the alternate lead-in contact arrangement using the alternate conductor wire 69A it would not be necessary to provide the additional pressure pad 71 except for end alignment purposes. While two alternate methods for applying excitation potentials to the alternate micro deflector bars have been disclosed, it is believed obvious to one skilled in the art that a cross bar connector could be used across the tops of the sets of bars wherein alternate deflection bars would be brazed or otherwise connected to the cross bar connector and the intervening bars where no electrical connection is to be provided an insulating space would be provided. Other suitable arrangements likewise could be employed and would be obvious to those skilled in the art in the light of the above teachings.

In addition to the metalized silicon deflection bars fabricated in two orthogonally arrayed sets as described above and shown in FIG. 5 of the drawings, each set of spaced-apart parallel deflector bars include elongated, end bars 61A and 61B which are parallel to the deflector bars 61 and elongated, end deflector bars 62A and 62B which are parallel to the deflector bars 62. The elongated, end deflector bars 61A, 61B, 62A and 62B all preferably comprise a suitable polished nonmagnetic metal bar such as molybdenum, tungsten or other similar metal that can be made electron optically clean and which provides sufficient rigidity to serve as a mounting means for mounting the sets of spaced-apart parallel metalized silicon deflector bars in place within the evacuated housing of an electron beam tube. It is also desirable that at least the ends of the elongated, end deflector bars 61A–62B be malleable to the extent that they can be bent to conform to a configuration whereby they can be clamped to a mounting ring or other supporting member located at a particular point within an electron beam tube housing. The micro deflector sub-assembly shown in FIG. 5, however, utilizes elongated, end deflector bars 61A, 61B, 62A and 62B wherein the ends of the bars project well beyond the glass support rods 68 to which they are likewise thermally bonded in the same heat treating process by which the metalized silicon deflector bars were secured to the glass support rods. The ends of the elongated, end deflector bars serve as mounting tabs for securement to an annularly-shaped metallic support ring 73 whereby each of the sets of the orthogonally arrayed, parallel, spaced-apart metalized silicon deflector bars 61 and 62 can be mounted in spaced-apart and juxtaposed relation. In order to minimize the spacing between the two sets of deflector bars 61 and 62, the ends of the elongated end deflector bars 61A and 61B are mounted to the upper surface of the support ring 73 as viewed by the reader, while the ends of the elongated, end deflector bars 62A and 62B are secured to the under-surface of the support ring as shown in FIG. 5. FIG. 6 of the drawings is a cross-sectional view of the micro deflector sub-assembly wherein it can be seen that the two sets of orthogonally arrayed, spaced-apart, parallel deflector bars 61 and 62 are spaced apart a short distance relative to the width of the bars, which distance may be of the order of only several milliinches.

Figure 7:
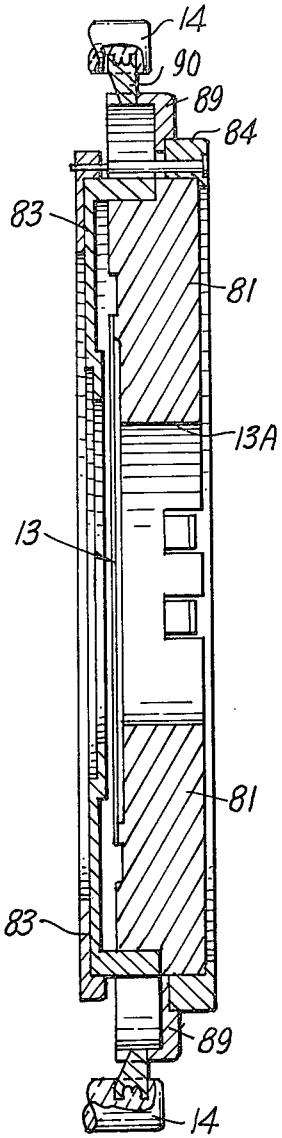
FIG. 7 is a sectional view of a target electrode sub-assembly comprising a part of the assembly shown in FIGS. 1 and 2.

FIG. 7 of the drawings is a cross-sectional view of the target electrode sub-assembly employed with the overall micro lens array and micro deflector assembly shown in FIG. 1. The target electrode sub-assembly 13 comprises a metal-oxide semi-conductor memory capacitor structure which may be of the type described in U.S. Pat. No. 4,079,358 issued Mar. 14, 1978 for a "Buried Junction MOS Memory Capacitor Target for Electron Beam Addressable Memory and Method of Using Same," Floyd O. Arntz, inventor, the teaching of which hereby is expressly incorporated in this disclosure. The MOS memory capacitor target member indicated generally at 13 is mounted for support on a fairly massive donut-shaped ceramic mounting member 81 having the MOS memory capacitor target member 13 supported over a central opening 13A therein. Bias potential as well as signals derived during read-out of the MOS memory capacitor target member are supplied through an insulating terminal (not shown) for application to the upper (closest to the mircro deflector sub-assembly) conductive surface of the MOS capacitive target member as described in the above-referenced U.S. Pat. No. 4,079,358. The backing support member 81 and a cup-shaped shield 83 are secured to an annularly-shaped outer support ring 84 for mounting to the axially extending common glass support rods 14.

Figure 8:
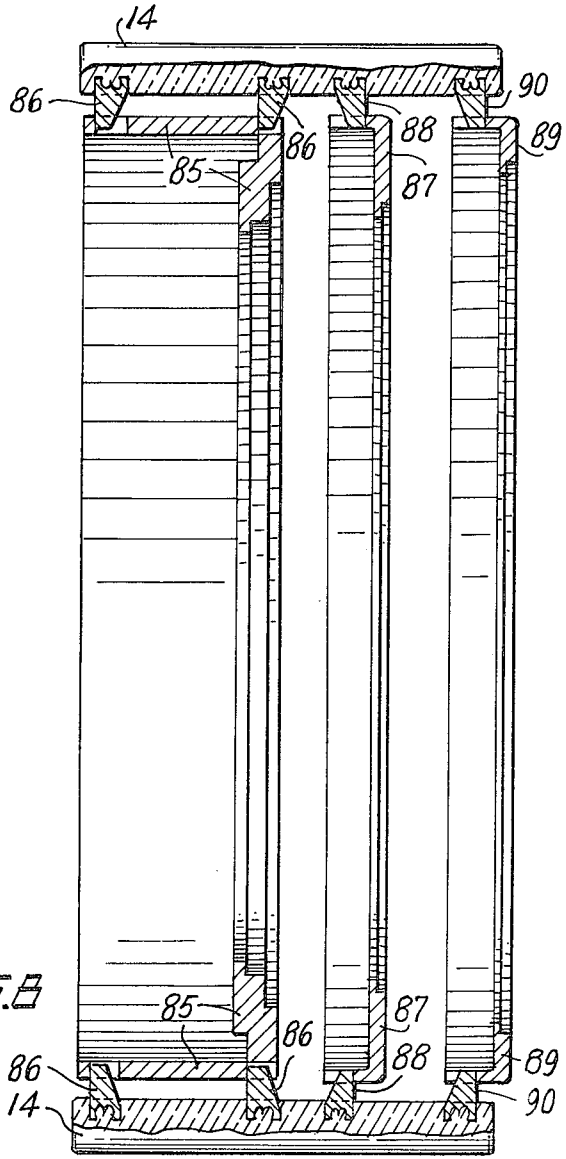
FIG. 8 is a longitudinal sectional view showing a plurality of annularly-shaped support rings and the manner of mounting the support rings to axially extending glass support rods, the support rings being used to mount the micro lens array sub-assembly, the micro deflector sub-assembly and a target electrode member in juxtaposed assembled relation for securement within the evacuated housing of a fly's eye type electron beam tube.

As best seen in FIG. 1 considered in conjunction with FIG. 8 of the drawings, the metallic mounting ring 22 for the micro lens array sub-assembly is brazed or otherwise secured to the inner peripheral edge of a cup-shaped outer support ring 85 that in turn is secured by trapezoidally-shaped mounting tabs 86 to the axially extending, peripherally arrayed glass support rods 14. In a similar manner, the outer support ring 73 for the micro deflector sub-assembly has its outer peripheral edge brazed or otherwise secured to the inner peripheral edge of a disc-shaped, metallic outer support ring 87 that is secured to the axially extending, peripherally arrayed glass support rods 14 by mounting tabs 88. Lastly, the support ring 84 for the target electrode sub-assembly 13 is brazed or otherwise secured at its outer periphery to the inner periphery of a second annular disc-shaped metallic mounting ring 89 that in turn is secured to the axially extending glass support rods 14 by mounting tabs 90. During assembly of each of the micro lens array sub-assemblies to axially extending glass support rods 14 by brazing or otherwise securing the support ring 22 to the outer mounting or support ring 85, proper axial alignment of the array apertures relative to the lens elements of the micro deflector sub-assembly 12 and to the target electrode member 13, is maintained by insertion of alignment rods in alignment notches or aperture openings formed in the respective mounting rings 22 as shown at 91 in FIG. 4, in mounting ring 73 as shown at 92 in FIG. 5, and in mounting ring 84 (the alignment notch of which is not shown). If desired, electron optical and/or light optical alignment procedures could be used in place of or to augment the mechanical alignment procedures noted above.

After assembly together in the above-described manner as shown in FIGS. 1 and 2 of the drawings, the resulting micro lens array and micro deflector assembly together with termination plate for the coarse deflection section and target electrode member will be seen to have been fabricated from silicon either in single crystal or polycrystalline form and glass to the greatest extent possible so that all parts of the assembly have comparable thermal properties and possess essentially the same thermal coefficient of expansion to the greatest possible extent. A number of the parts are processed in accordance with semiconductor micro-circuit fabrication techniques which provide exceptional quality roundness, symmetry and evenness of the aperture openings in the micro lens array together with exceptional symmetry in the spacing between openings. The entire assembly is held together by glass rodding or other similar material insofar as possible. The advantages obtained by fabrication of the assembly in this manner are that it reduces the cost and complexity of measures otherwise required to guard against rapid temperature changes between different parts of the electron optical assembly since the glass and silicon parts have substantially the same temperature coefficient of expansion. Silicon employed in the fabrication of most of the parts has greater stiffness and much better dimensional stability and can be used without closeby support rings or belts thereby making possible any desired lens plate thickness and any lens plate to lens plate spacing. It is much easier to cut and metalize silicon than fired ceramic or other material heretofore used thereby making the problem of fine deflector plate fabrication much less costly and better controlled. However, it should be understood that the use of ceramic deflector plates is not precluded. The fabrication techniques herein described result in an electron optically clean structure and, in addition, allows flexibility in forming the deflector bars so as to facilitate later assemblage and connection of deflection potentials to the bars.

Figure 10:
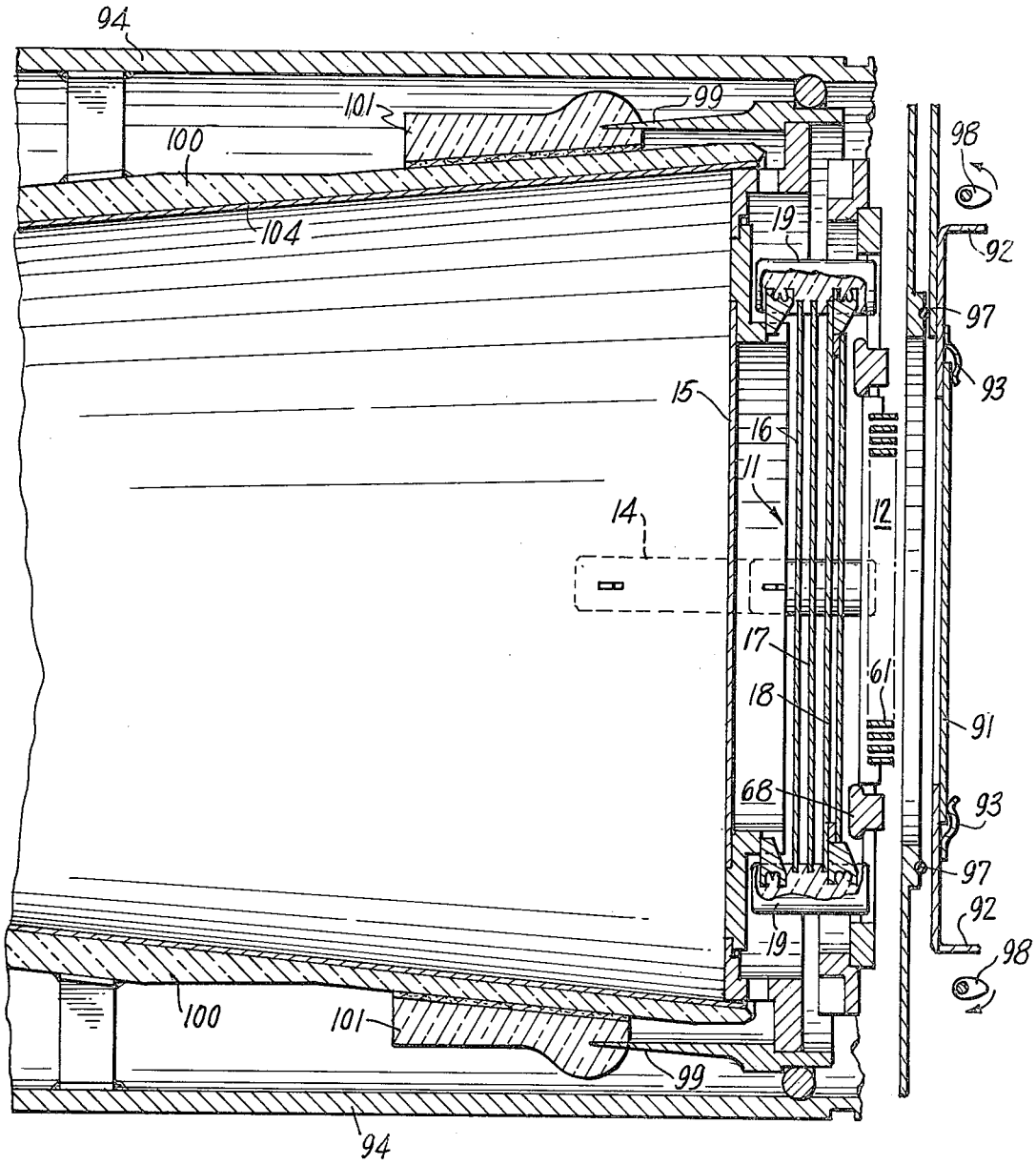
FIG. 10 illustrates a variation of the fly's eye type electron beam tube structure shown in FIG. 9 wherein a graded field coarse deflector system is employed whereby a uniform flood of electrons is supplied at the entrance end of the micro lens array and micro deflector assembly for use in the fabrication of micro circuit structures or the like employing electron sensitive target members.

FIGS. 9 and 10 of the drawings illustrate the new and improved micro lens array and micro deflector assembly used in conjunction with a different type of target member from that shown in FIG. 1. The arrangement shown in FIG. 1 of the drawings is for use with electron beam accessed memories employed in computer systems. The arrangements shown in FIGS. 9 and 10 of the drawings are intended for use in semiconductor micro-circuit fabrication or other comparable electron beam defined art work. For this reason, the arrangement shown in FIG. 9 includes a removable, electron sensitive target member 91 which is disposed immediately adjacent the micro deflector assembly on the electron beam exit side thereof for impingement of electrons thereon after deflection of the electron beam by the micro deflector sub-assembly 12. The electron sensitive target member 91 may comprise a photo-sensitive plate where the apparatus is being used for imaging or for alignment purposes, or the like, or alternatively, it may comprise an electron sensitive photo resist covered wafer having its electron sensitive surface placed opposite the exit side of the micro deflector assembly 12. The electron sensitive member 91 is clamped in place on a plate holder 92 by a set of clamps indicated at 93 which are arranged around the periphery of the plate or member 91. The electron sensitive plate or member 91 together with the plate holder 92 are held in place over the end of an evacuated tube, the outer housing or envelope of which is shown partially at 94 by reason of the vacuum produced within the interior of housing 94 by a vacuum apparatus (not shown) connected to the housing for the purpose of drawing down the atmosphere of the housing to low vacuum levels. In order to facilitate changing of the electron sensitive plates 91, a gate valve structure is provided which is designed to close over a central opening in the end wall 95 of the tube housing 94. During operation of the tube, the central opening in end wall 95 will be closed by the plate holder 92 and the electron sensitive member 91 held in place over the opening through the force of the spring clip 93. In order to change the electron sensitive plate member 91 after processing of the same, a linearly translatable gate valve member 96 is provided which can be slid into place over the central opening in end wall 95 and sealed against an O-ring seal 97 through actuation of a set of locking cam members shown at 98. With the gate valve member 96 in place over the central opening in the end wall 95, the electron sensitive target member 91 and plate holder 92 can be removed without complete loss of vacuum within the tube housing 94. Upon completion of the change of the electron sensitive target member 91, the gate valve 96 can be linearly withdrawn to the position indicated in FIG. 9 by appropriate actuation of the cam members 98 after placement of the new electron sensitive target member 91 and plate holder 92 back in position so that they are exposed to the interior of the housing as gate valve member 96 is withdrawn and the area above plate 91 in the housing again pumped down to a suitable level of evacuation.

The micro lens array and micro deflector target assembly 11, 12 is secured by means of a support ring 99 to a glass mounting ring or belt 101 thermally bonded to the exterior periphery of the coarse deflector cone 100 at a point adjacent the end 95 of tube 94. Support ring 99 forms a "housekeepers seal" by means of a thin depending skirt portion that is embedded in the glass mounting ring 101 during thermal bonding. A spring metal bond is disposed between the external periphery of support ring 99 and the internal circumference of outer housing envelope 94 completes the structures. By this construction, the amount of metal contained within the interior of the housing 94 is reduced to a minimum for purposes discussed above and the overall weight of the assembly and the effect of different temperature coefficients of expansion in the material used in constructing the assembly, are reduced to a minimum.

In the embodiment of the invention shown in FIG. 9, the coarse deflector section 102 of the coarse deflector cone 100 is disposed intermediate an electron gun assembly 103 for producing a fine, pencil-like beam of electrons and the micro lens array and micro deflector assembly (11,12). The coarse deflector section 102 preferably is designed pursuant to the teachings of U.S. patent application Ser. No. 812,981, filed July 5, 1977, Kenneth J. Harte, inventor, the disclosure of which hereby is incorporated in its entirety. The electron beam projected from the electron gun assembly 103 through the coarse deflector section 102, is selectively deflected by the coarse deflector to pass through a selected one of the 128 by 128 array of aligned openings in the termination plate 15. The electron beam then passes through the corresponding axially aligned lenslet apertures in micro lens array sub-assembly 11 and the axially aligned micro deflection element in the micro deflector sub-assembly 12 to thereafter selectively impinge upon the electron sensitive target member 91 at a point determined by the fine x-y deflection voltages applied to the micro deflector sub-assembly. By this means, extremely fine control over the positioning of the point of impingement of the electron beam on the electron sensitive target member 91 is achieved.

The embodiment of the invention shown in FIG. 10 differs from that of FIG. 9 in that it employs a different form of electron gun assembly 103. The FIG. 10 species preferably uses a field emission type of electron gun for producing a flood of electrons that are directed through a graded field structure shown at 104 which completely circumscribes the interior surface of the coarse deflector cone 100, and which is used in place of the coarse deflectors 102 employed in the FIG. 9 arrangement. The graded field structure 104 is designed to produce a uniform flood of electrons that covers the entire surface of the termination plate 15, and hence uniformly simultaneously passes electron beams of reduced beam current through all the micro lenslets in the sub-assembly 11 and corresponding micro deflector elements in the micro deflector sub-assembly 12. After passing through the micro deflector sub-assembly 12 there will be a multiplicity of essentially parallel electron beams all of which will be deflected uniformly by the micro deflector 12 onto discrete areas of the electron sensitive target member 91. Assuming, for example, that the micro lens array provides a matrix or array of lenslets numbering 128 by 128, then a corresponding number of target areas will be traced on the electron sensitive target member 91 within the scope of deflection of the respective micro deflection elements and it becomes possible to uniformly control fabrication of up to 128 by 128 (16,384) microcircuit assemblies simultaneously.

Figure 11:
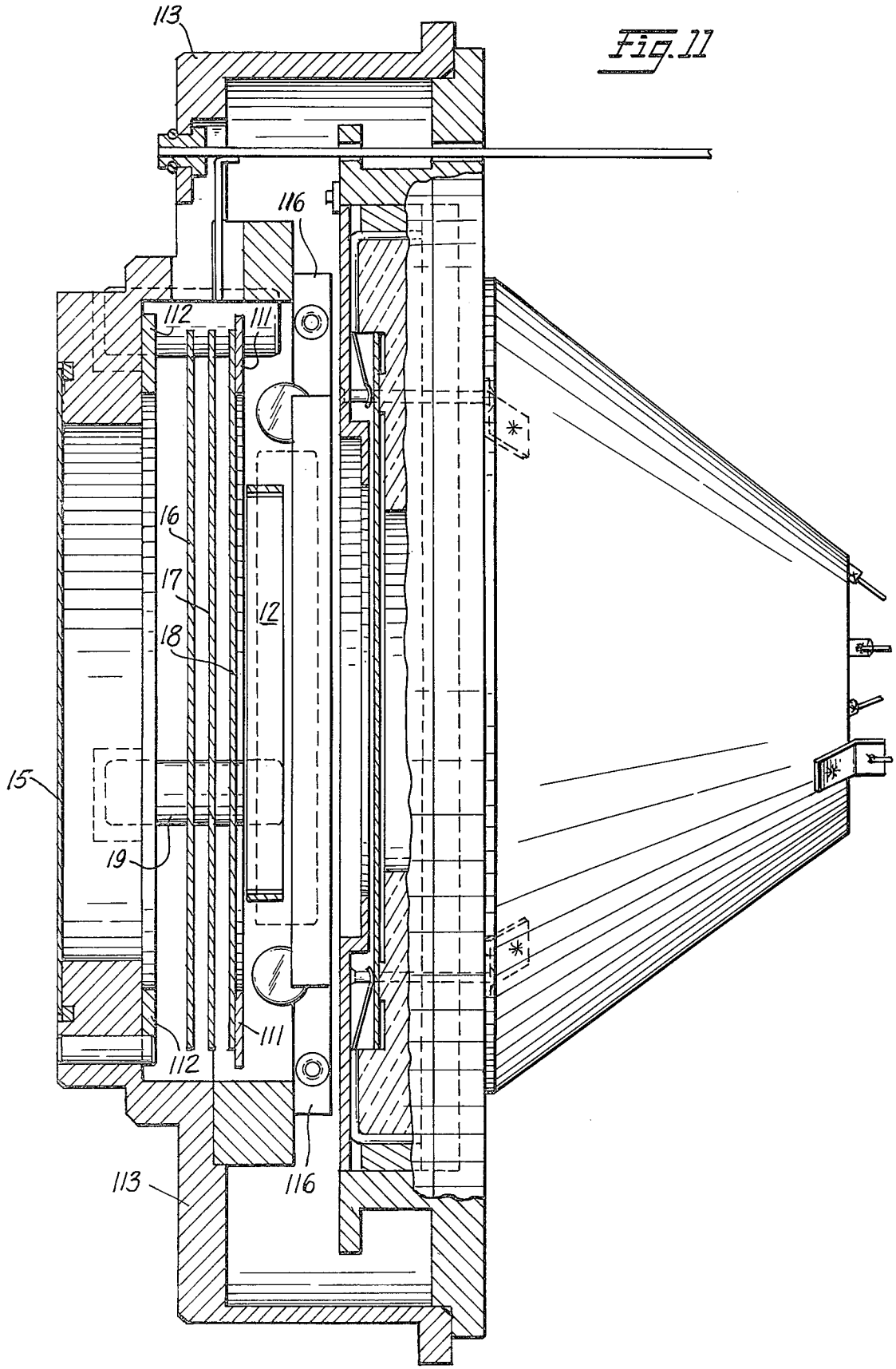
FIG. 11 is a longitudinal sectional view of another embodiment of the invention employing silicon micro lens plates and thin metal deflector bars mounted on glass support rods in individual sub-assemblies with each sub-assembly being mechanically held to-gether by annularly-shaped metallic support rings.

Referring now to FIGS. 11–16 of the drawings, a different embodiment of a micro lens array and micro deflector assembly is shown which is somewhat different from the species of the invention described with relation to FIGS. 1–10. The FIGS. 11–16 species employs metal support rings and cup-shaped outer supports for holding the various sub-assemblies together in a complete structure. In FIG. 11, the micro lens array sub-assembly is shown as comprising a plurality of stacked, parallel, thin silicon plates 16, 17 and 18 fabricated in somewhat the same manner as described with relation to FIGS. 17 and 18 of the drawings. In the micro lens array shown in FIGS. 11–14, the required lens aperture (hole) profile as shown in FIG. 17, can be obtained by a variety of known photolithographic and etching techniques employed in the fabrication of semiconductor integrated microcircuits. For example, in a manner similar to that shown in FIGS. 18A–18J, an N-type wafer of single crystal silicon of approximately ½ millimeter thickness and 100 orientation has a periodic oxide pattern produced on its two surfaces as shown in FIG. 18E. The pattern is the negative of the desired hole pattern and is produced by well-known oxidation and photo resist techniques. The patterns on the two sides of the silicon wafer may be the same size as shown but also may be different where one is fabricating the end plates as illustrated in FIG. 17. For end aperture plates the smaller holes are essentially the required aperture diameter while the larger holes on the opposite side are made as large as practicable without completely undercutting the underlying silicon supporting the aperture during the etching step. Having established the oxide pattern, a P+ dopant material is diffused into the exposed surfaces of the silicon wafer by thermal diffusion through the oxide mask as shown in FIG. 18E. The wafer is then etched using an orientation sensitive etch, for example, a hot pyrocathecol and ethylene diamene bath, is employed so that differential etching progresses from the two side of the undoped silicon as illustrated in FIGS. 18H and 18J. The geometrically perfect outline of the aperture opening is determined by the perfection of the crystal planes of the silicon which produces intersecting square based pyramids as shown in the combined views of FIGS. 18I and 18J. FIG. 18J is a plan view looking toward the bottom of FIG. 18I and thus shows the two circular boundary apertures 36 and 37 supported on the thin P+ boron doped layer with the pyramidal opening in the intervening undoped N-type silicon wafer intersection to form essentially square-shaped openings in the center of the thickness of the silicon wafer. Having established the correct structure for the aperture opening in the thin silicon plate, a coating of metal may then be placed over the entire structure to make it conductive. Any of the well-known metalization techniques may be employed so long as there is adequate metal to stop the electron beam completely. The method of ion plating identified earlier in the "Electron Beam Techniques For Ion Plating" article and in the "Physical Vapor Deposition" article, are preferred because the plating metal reaches internal surfaces and adheres well. For a 10 kilovolt lens, a thickness of 2000 Angstrom units of heavy metal such as gold or platinum is adequate. The key item for the apertures is the profile of the small circular openings as illustrated in FIG. 17. The profile of the intervening underlying silicon support is not critical. The key factor then is the doped, thin surface layer 33 which defines and determines the areas of differential etching action for production of the aperture openings and which must not be destroyed by the etchant used in forming the aperture openings.

There are a variety of different, known ways in the art for accomplishing the above-described differential etching action other than that described earlier with relation to FIGS. 18A through 18J. For example, the thin surface layer may be produced by epitaxial growth of a P+ layer on an N-type silicon wafer. The hole structure is defined by ion implantation of N-type material through an oxide mask with holes where implantation is desired or by thermal diffusion of N-type material through the holes. Etching can then follow in the same manner as described with relation to FIGS. 18A–18J. To form the desired holes, since the form of the intervening supporting undoped silicon is not critical, one could substitute an isotropic etch for the orientation dependent etch in which case the silicon supports could follow a generally hemispherical outline rather than the pyramidal outline illustrated. In producing the center lens plate 17 shown in FIG. 17, a further restriction must be observed in that the symmetry of the supporting intervening silicon must be maintained with a high degree of accuracy due to the fact that the aperture holes 36 and 37 on both sides of the plate are equal in diameter. Because the orientation sensitive etching procedure described above maintains four-fold symmetry of the intervening supporting silicon, it is preferred because it may be so oriented as to correct the four-fold pattern of interaction between neighboring lenslets in an array of micro lenslets. By alternating orientation sensitive etching steps with other etching techniques, it is also possible to produce different configurations within the intervening supporting silicon but of course the processing procedures become more complex requiring greater skill and care in the fabrication.

In the embodiment of the invention shown in FIGS. 11–16, the micro lens array is made as a stand-alone sub-assembly and for this purpose is provided with top and bottom support rings as best shown in FIGS. 13 and 14 at 111 and 112, respectively. The support rings 111 and 112 are thermally bonded or otherwise secured to the axially extending glass support rods 19 along with the apertured thin silicon lens plates 16, 17 and 18 (and 18A if provided) with the lower support ring 112 contacting and physically bracing the lens plate 18A to prevent microphonics being induced therein by deflection frequency fields produced by the adjacent micro deflector sub-assembly. The micro lens array sub-assembly shown in FIGS. 13 and 14 then is mounted in the overall assembly as best seen in FIGS. 11 and 12 by means of a central, annular cup-shaped mounting member 113. This annular, cup-shaped mounting member 113 serves to hold the entire assembly together along with the termination plate 15 which is secured to the outermost end portion of member 113 with its aperture openings axially aligned with corresponding apertures in the micro lens array sub-assembly. Excitation potentials of about 5–10 kilovolts are supplied to the inner thin silicon lens plate 17 by means of an insulator mounted conductor connected by means of an intermediate conductor wire to the conductive upper surface of the central lens plate 17. The end plates 16 and 18 can be operated at essentially ground potential for the equipment and suitable lead-in conductors to plates 16 and 18 are provided for this purpose.

The micro deflector sub-assembly employed in the embodiment of the invention shown in FIGS. 11 and 12 is best seen in FIGS. 15 and 16. In this micro deflector sub-assembly, the fine deflector blades are made of individual molybdenum blades which are sawed from a block of molybdenum or alternatively, individually blanked from sheet stock, and are stacked alternately with spacers and then bonded together at their ends to glass support rods 114 and 115, respectively. The resulting sets of parallel, spacedapart fine deflector bars are provided with elongated end bars as shown at 61A, 61B, 62A and 62B, the elongated ends of which extend beyond the points of connection to the glass support rods 114 and 115, respectively. The elongated end portions 61A–62B are brazed or otherwise secured to an outer annular support ring 116 for the micro deflector sub-assembly. As best seen in FIG. 11 of the drawings, the outer support ring 116 is secured to the central annular cup-shaped mounting member 113 for holding the micro deflector sub-assembly in spaced-apart, parallel relationship with respect to the micro lens array sub-assembly with the individual micro deflector elements of the sub-assembly axially aligned with the individual lenslets apertures of the micro lens array.

The complete fly's eye electron beam tube deflector/lens combination is assembled by spot welding the mounting tabs from each of the micro lens array and fine deflector sub-assemblies to the central, annular, cup-shaped mounting member 113. To assure proper registration and axial alignment of the respective lenslets and micro deflector elements, "V" notches are placed in the peripheral edge portion of the mounting rings and these are registered against round alignment pins at each stage of fabrication and assembly starting with the photo mask registration during fabrication of the thin apertured silicon lens plates 16, 17 and 18. The V notches and round alignment pins or rods are best seen in FIG. 12 at 117, 118, 119 and 121. FIG. 15 in conjunction with FIG. 12 illustrates the manner of connection of deflection potentials to alternate ones of the sets of spaced-apart, parallel deflector bars 61M and 62M. Referring to FIG. 15, the +X deflection potential is applied through a cross bar conductor 122 which is spot welded to alternate ones of the micro deflector blades or bars 62M and the −X deflection potential is connected through a conductor 123 to the remaining alternate ones of the micro deflector bars 62M. In a similar manner, the +Y deflection potential is connected through a cross bar type conductor 124 which is spot welded to the tops of alternate ones of the micro deflector bars 61M while the −Y deflection potential is connected through a cross bar conductor 125 spot welded to the top of the remaining alternate ones of the deflector bars 61M. By this construction, suitable deflection potentials are applied to all of the micro deflector elements simultaneously for appropriate fine deflection of an electron beam passing through any one of the elements as described previously.

During final assembly, the locating or alignment rods are held in precisely machined holes in the central annular cupshaped mounting member 113 while assembly takes place. After spot welding the mounting tabs of the micro lens array and micro deflector sub-assemblies to the central mounting member, the locating or alignment rods are removed otherwise they would give redundant constraints, and if metallic, would electrically short circuit certain of the elements. It is also possible to obtain better alignment by use of electron optical or light optical registration and alignment techniques instead of the notches and alignment rods as described. As mentioned previously, to make the micro lens array a stand-alone sub-assembly, it was necessary to add two stiffening rings which as indicated, are formed from molybdenum. It is also possible to use metallic coated ceramic, metallic coated polycrystalline silicon, tungsten, or metallic coated amorphous carbon. Of the metals, tungsten most closely matches the termal coefficient of expansion of silicon; however, for ultimate thermal match, polycrystalline silicon having its surfaces metalized would be the best. The polycrystalline silicon is preferred for use as a stiffening member not only because it is cheaper to fabricate, but also it is stronger than single crystal silicon which has a tendency towards easy fracture in certain directions.

In operation, the assembly shown in FIGS. 12–16 functions in precisely the same manner as the assembly described with relation to FIGS. 1–10. It should be noted, however, that because of the use of the rather massive central, annular, cup-shaped mounting member 113, the arrangement of FIGS. 11–16 requires the use of more metal whose temperature coefficient of expansion is considerably different from that of silicon and glass. Thus, creation of thermally induced stresses are more likely to be encountered with the arrangement of FIGS. 11–16 than is true with the assembly shown in FIGS. 1–10. For this reason alone, the FIGS. 1–10 species is preferred but in addition, it is considerably cheaper to manufacture and lighter in weight also.

FIG. 20E of the drawings illustrates an alternative form of micro deflector sub-assembly construction which is different from that described with relation to FIGS. 20–20D and the FIG. 1 and FIG. 11 species of the invention. In FIG. 20E a set of spaced-apart, parallel metalized silicon deflector bars or blades 61 are permanently set in a block of silicon 66 having a through opening 66A shown in FIG. 20B and having slots 67 to accept the deflector bars 61. This is achieved in much the same manner as described with relation to FIG. 20C. However, in FIG. 20E the block 66 is made insulating as by growing a silicon oxide layer thereover, and the deflector bars 61 are permanently secured within the block of silicon 66 by means of glass frit or thermal bonding as shown at 131. In a similar manner the metalized silicon deflector bars 62 are permanently mounted in an insulating block 132 having a physical configuration similar to that shown in FIG. 20B but formed from ceramic, or silicon oxide coated silicon so that it is electrically insulating. The metalized silicon deflector bars 62 again are permanently secured in the slots in block 132 by glass frit, thermal bonding or otherwise. Deflection potentials are applied to alternate ones of the deflector bars 61 and 62 as described previously through the conductors 133, 134, 135 and 136. The entire assembly can be held together by thermally bonding the top surfaces of the second insulating block 32 to the lower edge portions of the deflector bars 61 and a suitable mounting ring secured thereto by mounting tabs as described earlier whereby the structure can be mounted in assembled relationship adjacent with a micro lens array sub-assembly similar to FIGS. 1 or 11. While the fine micro deflector structure shown in FIG. 20E has certain advantages, it is expensive to fabricate in that the silicon and ceramic or oxide coated silicon blocks 66 and 132 are not reuseable and hence the design requires a substantial amount of rather expensive material. For this reason, the fine deflector structure shown in FIG. 20D is preferred wherein the respective sets of orthogonally arrayed deflector bars 61 and 62 are thermally bonded to transversely extending glass support rods 68 at the ends thereof as described earlier. The blocks of silicon 66 having the slots 67 sawed therein then may be reused as holding fixtures thereby economizing greatly from a material viewpoint.

FIG. 20F illustrates still another modified form of micro deflector sub-assembly constructed according to the present invention. In FIG. 20F the orthogonally arrayed sets of spaced-apart, parallel micro deflector bars are held in assembled relationship by respective glass support rods 68 extending at right angles to the bars and connected thereto at respective ends of the bars as described earlier with respect to the FIG. 20D species of the invention. In FIG. 20F, however, in place of securing the metallic elongated ends of the end deflection plates 61A, 61B, 62A and 62B to an annular support ring for securement to the axially extending main glass support rods 14, the elongated ends 61A–62B are fabricated from a malleable material such as tungsten so that they can be bent at substantially right angles to directly contact and be thermally bonded to axially extending glass support rods 14 in the manner shown in FIG. 20F and in FIG. 21. With the micro deflector sub-assembly secured to the main axially extending glass support rods 14, the peripheral edges of thin silicon lens plates 16, 17, 18 and 18A (if used) can be directly thermally bonded to the axially extending main glass support rods 14 as shown in FIGS. 21 and 21A. The structure thus greatly simplified by the absence of the mounting rings, is completed by directly thermally bonding the peripheral edge of the target electrode member 13 to the axially extending main glass support rods 14 and the termination plate 15 likewise is directly thermally bonded to the main glass support rods 14. The assembly thus comprised may then be secured to the inner peripheral edge of a suitable mounting ring support such as shown in FIG. 25 for support within the housing or other envelope of an electrode beam tube of the fly's eye type. The resulting assembly would comprise essentially only silicon and glass components and minimizes to the greatest possible extent the use of materials having temperature coefficients of expansion widely different from those of silicon and glass. In addition to this rather substantial benefit, the cost of the components is greatly reduced as is the cost of their processing not to mention the reduction in weight and ability to minimize the size of the entire assembly.

In the effort to miniaturize the size of the combined micro lens array and micro deflector assembly in the manner depicted in FIG. 21 and FIG. 21A of the drawings, the physical spacing between the thin, apertured silicon lens plates 16, 17 and 18 can become critical. In order to overcome this problem, and still at the same time insure an adequate amount of insulator between adjacent edges of the spaced-apart lens plates whereby they will be able to withstand substantial potential differences of the order of 5–10 kilovolts or perhaps even greater, the plates can be mounted to modified glass support rods as shown in FIGS. 22 and 22A of the drawings. In each of these Figures the glass support rods are provided with suitable inwardly extending projections which contact the peripheral edge portions of the silicon plates at the point of thermal bonding whereby the effective insulator distance between adjacent silicon plates can be made to be much greater than the plate separation distance. For this purpose, the axially extending, main glass support rods such as 14A in FIG. 22 are provided with inwardly extending branches 137. As an alternative, the main axially extending glass support rods, such as 14B in FIG. 22A, may be bowed outwardly as shown at 138 for the extent thereof corresponding to the space between adjacent lens plates.

FIGS. 23 and 23A of the drawings illustrate another alternative method of securing together the orthogonally disposed, metalized silicon micro deflector bars 61 and 62 having the ends thereof secured to glass support rods 68A and 68B, respectively, as described previously. In FIG. 23 and and FIG. 23A, the glass support rods 68A and 68B to which the respective ends of the micro deflector bars 61, 62 are thermally bonded, are extended sufficiently so that they intersect one over the other and are thermally bonded together at the point of intersection. A small, insulating, sapphire ball shown at 139 may be interposed and thermally bonded to the intersecting glass support rods 68A and 68B at the points of intersection to adjust the spacing between the sets of deflector bars. With the construction shown in FIGS. 23 and 23A, it is possible to get the closest possible spacing between the orthogonally disposed metalized silicon deflector bars 61,62 without requiring the need for elongated, metal end deflector bars as discussed in earlier described arrangements. To mount the micro deflector sub-assembly, the glass support rods 68A and 68B may be extended sufficiently to allow one or both to be secured to a mounting ring. Alternatively, an axially extending glass rod 14 can be directly thermally bonded to the intersection of 68A and 68B for mounting within an electron beam tube as indicated by dotted lines at 14 in FIG. 23.

As described earlier with respect to FIG. 1 and FIG. 11 species of the invention, for holding the micro lens array and micro deflector assembly together or for mounting the assembly in a fly's eye electron beam tube structure, one may use any of the standard fastening means such as spot welding, brazing or even bolting together, all of which have been used in prior art devices. For example, it is not unusual to use a combination of machine screws and spot welding for assembly.

Spot welding the component parts of a fly's eye electron beam tube has disadvantages in that it is limited to joining conducting materials. Thus for joining silicon and ceramics or glass, an additional step of providing mounting tabs or flanges is required. Spot welding also creates debris and is not suited to ready disassembly for realignment or replacement or component parts. Additionally, spot welding segregates alloys, causing instability and magnetic combinations to be formed during the spot welding procedure in nearby metal parts that are magnetizable. Finally, spot welding produces stretching at certain points of the metal parts being joined thereby resulting in distortion and leaves rough surfaces which can cause corona and arc-over during operation of the electron beam tube.

Brazing of the sub-assemblies together for mounting the resulting micro lens and micro deflector assembly within the electron beam tube has disadvantages in that it requires complex fixturing to maintain alignment through a high temperature cycle required to braze the parts together. Additionally, the brazing process may require fluxes which are difficult to remove after the brazing operation in order to make the assembly electron optically clean. It is difficult to retain the brazed filler at the desired locations where jointures are to be accomplished and finally, the resulting structures cannot be readily disassembled non-destructively.

Bolting or assembly through machine screws had disadvantages in that the bolts or screws generally are conductors and thus require complex insulator sleeving, spacers, etc. to avoid shorting out different parts of the assembly. Tightening of the bolts or machine screws tends to force the assembly out of alignment just as it approaches final position unless very elaborate means are employed through complex and bulky clamps and fixturing to separate the clamping force from the rotation which produces the force. Additionally, available screws and bolts have thermal coefficients of expansion which are not close enough to the coefficient of expansion of silicon and ceramic insulators to maintain the assembly integrated throughout the bake-out cycle. To produce screws and machine bolts of special materials such as tungsten in order to overcome this problem, removes the cost advantage of using bolts and screws in the first place.

In the products herein described, glass rodding as a means for assembling the various component parts together into sub-assemblies and thereafter joining the sub-assemblies into a complete assembly, is preferred since the cost and integrity of the resulting structures are quire acceptable and the techniques for glass rodding well known and proven. In the case of faulty assembly, by "cracking the glass" the expensive parts of the assembly such as the thin silicon lens plates and micro deflector bars generally can be reclaimed. Since the glass rodding is not too expensive, this method of disassembly is acceptable for realignment and replacement problems.

As noted in the preceding paragraph, the glass rodding technique of assembly does not lend itself readily to easy nondestructive disassembly. In those applications for a fly's eye electron beam tube where disassembly is a key factor, as for example in use of the fly's eye electron beam tube for art work generation in the fabrication of microcircuits, and the like, an assembly method employing precision sapphire balls mounted in conical recesses can be employed. This basic method of assembly is disclosed in FIGS. 24, 24A, 26, 26A, 26B and 27 of the drawings. As may be expected, the thin, apertured silicon lens plates are too brittle to be clamped between precision sapphire balls without taking special steps to accommodate this technique of assembly. As shown in FIG. 24, one procedure is to fuse the peripheral edges of the thin silicon lens plates such as 16, 17 and 18 to axially extending glass rods 14. The micro lens array sub-assembly thus comprised can then be separately mounted on a mounting ring such as shown at 141 in which circular openings 142 are formed. A small insulating sapphire ball 143 is inserted in the hole or opening 142 in mounting ring 141 and the end of the supporting glass rod then thermally shaped to form sockets for seating the insulating sapphire balls 143. FIG. 24A of the drawings illustrates a technique for fabrication of the structure shown in FIG. 24 using a vacuum chuck and gas flame to heat the glass support rods 14 to approaching their melting temperature. The thin, apertured silicon lens plates 16, 17 and 18 are then pressed into engagement with the glass support rod 14 by suitable holders (not shown) and either concurrently or sequentially, the insulating sapphire balls mounted in suitable holders 145 and 146 are brought into engagement with the heated ends of the glass support rods 14 to simply press a ball seat in the ends of the glass rods. The glass support rods 14 cool slowly enough to permit forming the ball sockets all in one operation immediately after pushing the glass support rod into proper mounting position with relation to the balls and thin silicon plates 16–18. The sequence of operations are (1) the glass rod 14 i moved to the right to engage the ends of the thin apertured silicon lens plates 16, 17 and 18 after being heated by the glass flame. Downward motion of the sapphire ball holder 145 and upward motion of the sapphire ball holder 146 indicated as motions 3 and 6 may occur simultaneously with motion 1 with these motions being sequentially followed by motions 2, 4 and 5 to withdraw the furnace and holders from the glass rodded sub-assembly shown in FIG. 24. The resulting structure then is mounted as shown in FIG. 24 on mounting ring 141 having apertures 142 for receiving the small insulating sapphire balls 143. In place of using the gas flame heating, one could use heating methods employing electron heat fusion, laser heat fusion or radio frequency heating of the glass rod prior to pressing the thin apertured silicon lens plate and sapphire balls into position on the rods. The inexpensive, artificial sapphire spheres used as the insulating balls 143 are ideal as forming tools for fabrication in accordance with this technique.

FIG. 25 illustrates a preferred method for attaching a flange to a coarse deflector cone for electron beam tubes of the fly's eye type wherein the coarse deflector cone 90 has the coarse deflector electrode 102 formed thereon by any suitable known metalization glass technique. The ends of the coarse deflector cone 90 on the outer surfaces thereof are shaped to receive and coact with a metal mounting band 147 having an outwardly extending flange portion 148 to which are secured suitable glass rod mounting tabs such as 86, 88 and 90 described with relation to FIG. 1 of the drawings. The flanged metal band 147,148 is secured to the ends of the glass tube envelope 90 by heat shrinking the band 147 over the end of the glass tube. The metal band 147,148 may be prefinished in advance of the heat shrinking process, or alternatively may be finished after securement to the sides of the glass tube. The structure shown in FIG. 24 may be mounted on a mounting flange similar to that shown in FIG. 25 and which corresponds to the mounting ring 141 shown in FIG. 24. To heat the metal band 147, it could be heated with radio frequency electric fields or electron, or laser beam heating as well as by a gas fired furnace while the glass envelope 90 of the tube is maintained substantially at normal room or ambient temperature. The dimensions of the metal band 147 are proportioned so that upon being heated it can just be slipped over the end of the tube glass envelope 94 and upon cooling will shrink fit to a tight bond.

FIGS. 26, 26A and 26B illustrate still other forms of the invention for use in fly's eye electron beam tubes of the type that must be easily broken down and taken apart for operational use. In the embodiment shown in FIG. 26, the central thin apertured silicon lens plate 17 is provided with a set of relatively thick pads shown at 151 and 152 secured on both sides of an outer peripheral edge portion thereof. Each of the pads 151 and 152 has a pyramidal or conical shaped opening indicated at 153 formed therein for receiving and seating a small, insulating sapphire ball such as shown at 143 and 143A. The sapphire ball 143 itself is seated in a circular opening formed in the peripheral edge portion of one of the outer thin apertured silicon lens plates 16. The sapphire ball 143 also seats in a pyramidal or conical shaped cavity 153 in a thick pad 154 secured to a peripheral edge portion of the termination plate indicated at 15. The sapphire ball 143A is designed to seat in the pyramidal or conical opening 153 formed in the lower pad 152 and in turn seats in an opening formed in the peripheral edge of the lower thin apertured silicon lens plate 18. The lower end of the lower insulating sapphire ball 143A in turn is seated in a circular opening in the annular mounting ring member 87 of a micro deflector subassembly 12 which may be fabricated as described with relation to FIG. 1 of the drawings. The entire assembly including the termination plate 15 and mounting ring 87 may then be supported within an evacuated electron beam tube housing in a manner to be described hereinafter with respect to FIG. 27, for example. Thus, it will be appreciated that with the arrangement of FIG. 26, disassembly of the components of the micro lens array for realignment purposes, etc. is facilitated without requiring breakage of glass support rods, or the like.

FIGS. 26A and 26B illustrate modified constructions for the insert washers to be placed between the thin apertured silicon lens plates in order to control the spacing distance between plates and at the same time provide an adequate thickness to facilitate use of the small sapphire balls employed in assembling the elements in a composite structure such as shown in FIG. 26. In FIG. 26A the insert is shown as a relatively thick, flat annular washer type of spacer 155 having a central opening of sufficient dimension to accommodate the ends of the small sapphire insulating spacer balls 143. In the FIG. 26B species, the additional washer-like spacer 156 is provided with rimmed edge portions to accommodate the peripheral surfaces of openings formed in the thin apertured silicon lens plates. In each of these species, if the lens plates to be spaced apart are to be maintained at different potentials, the spacers 155 and 156 would be fabricated from electrical insulating material such as glass, aluminum oxide or silicon dioxide coated silicon or other similar compatible material. If the adjacent plates to be spaced apart are to be maintained at the same potential, then the spacers may be fabricated from a suitable metal such as molybdenum or tungsten.

The easily disassembled "ball alignment" structure can be used for silicon plates if the plate separation is large enough to hold the potential difference across the ball surface. For example, at least a 5 kilovolt potential difference is generally required to be placed between adjacent plates. With sapphire balls, the minimum diameter corresponding to sound design practice lies in the range of 4–5 millimeter diameter balls. With the "ball alignment" structure, one of the constraints encountered is that the balls must be aligned and must not touch one another. This requirement in turn places a requirement for the use of the additional thick pads or spacer elements placed between adjacent siliconplates. The angle of contact of the balls with the peripheral edge portions of the holes in the silicon plates designed to accommodate the balls must be approximatelyat the point of equal division between vertical and horizontal loading. Typical numbers derived as exemplary are: ball diameter=5.00 mm., contact angle=45°, plate separation=3.54 mm., leakage path=3.93 mm., and minimum plate thickness=1.46 mm.

FIG. 27 shows a micro lens array and micro deflector sub-assembly similar to those shown in FIGS. 23 or 24 mounted on the end of the coarse deflector cone 90 of an electron beam tube together with termination plate 15 and target electrode member 13 to provide a readily disassembled and remounted assembly employing both "ball alignment" and "glass rodding" techniques. For conveninece, only one side of the structure is shown with the end of the coarse deflector cone 90 terminating in a shrink fitted metal mounting flange 147 having an outwardly extending rim 148 constructed according to FIG. 25 of the drawings. The rim 148 of mounting flange 147 has a lip which receives and seats the termination plate 15 having ball seats formed therein for accommodating alignment balls 143 for seating and supporting the lower ends of the support rods 14 for the micro lens array 11. The micro lens array 11 may be fabricated as shown in FIG. 24 of the drawings and has its upper sapphire balls seating and supporting the lower ends of the axially extending glass support rod 14 of a micro deflector 12 constructed as described with relation to FIG. 23 of the drawings. An alignment ball 143 seated on the top of the axially extending glass support rods 14 of the micro deflector in turn is seated in the pyramidal shaped opening of a set of spacer pads 151 and 152 are spaced on either side of the target electrode member 13 in a manner similar to that described with relation to FIG. 26. The spacer ball 143 seated in the opening on the top of the spacer pad 151 in turn seats in an opening in an annular compression plate 157 that may comprise an integral part of the end cap structure 158 for the array optics assembly. The combined end cap and compression plate 157,158 is provided with an outer mounting flange 159 having openings therein that form seats for the alignment sapphire spheres 143. The entire structure comprising compression plate 157, end cap 158 and mounting flange 159 may be fabricated from glass or an electron optically clean metal such as tungstem or molybdenum, ceramic or other suitable material having the required imperviousness to gases and structural rigidity. Mounting flange 159 has a grooved surface around its outer periphery in which the sapphire balls 160 seat in the upper flange 161 of an outer housing envelope member 162 for the micro lens array and micro deflector assembly. Housing member 162 also has a lower mounting flange 163 coacting with the rim portion 148 of metal band 147 to seat and support the assembly on sapphire balls 164. The mounting flanges 159 and 161 and 163 and 148 are compressed together against the sapphire balls 160 and 164 by a set of Inconel steel compression springs shown at 165 inserted by means of a loading tool 166. After insertion with the loading tool, the clamping springs 165 rigidly hold the entire structure in assembled relationship.

As an alternative to the arrangement shown in FIG. 27, where the intended application of the fly's eye, electron beam tube does not require ready disassembly for changing target members 13, such as where the intended application is for use as an electron beam accessible computer memory, the combined micro lens array and micro deflector assembly including target member 13 shown in FIG. 21 of the drawings could be inserted bodily in place of the three part assembly comprised by sub-assemblies 11, 12 and 13 of FIG. 27. With such an arrangement, the ends of the axially extending glass support rods 14 shown in FIG. 21 would be compressed to receive the alignment balls 143 employed in mounting the micro lens array and micro deflector assembly between compression plate 157 and termination plate 15 of the structure shown in FIG. 27. Needless to say, the termination plate arrangement 15 illustrated in FIG. 21 would not be required in any such modification since it would be redundant in view of the use of the plate 15 as a compression member in the modified FIG. 27 structure.

The technique and apparatus for fabricating thin, apertured silicon lens plates for micro lens arrays according to the invention lends itself to improved methods for reduction of third order spherical aberration of the lens (which varies as the cube of the lens aperture in radius or angle). It has been established that third order aberrations in electron lenses can be corrected by one of three methods:

(1) Use of some unround apertures.
(2) Place a source of charge near the lens axis.
(3) Vary the lens power with time.

The last method described in (3) above requires impracticably high rates of variation. The second method described in (2) becomes progressively less attractive as the beam energy is reduced and is best suited to electron beam energies above 30 kilovolts. The unround aperture technique described in (1) is the most attractive since it will work at any voltage and is not restricted in use to higher beam energies. The double, thin conducting film cross-sectional configuration of the silicon lens plates 16, 17 and 18, is well adapted to the formation of unround lens apertures on either side of the plates as best illustrated in FIGS. 28 and 28A of the drawings. Referring to FIG. 28, an upper silicon lens plate 16 is fabricated with a small diameter circular aperture 171 formed in its upper surface and an elliptical or semi-elliptical aperture 172 formed in its lower conducting surface. When viewed from below, the plane of the lens plate would then appear as shown in FIG. 28 to provide the unround aperture openings 172 for correction of the undesired third order aberrations. The unround (elliptical or semi-elliptical) openings 172 may of course be fabricated by appropriate design of the photo-resist pattern employed in defining the undoped silicon surfaces to be etched by the etchant as described previously with respect to FIGS. 18A–18J of the drawings. FIG. 28A is a cross-sectional view through one of the unround apertures shown in FIG. 28. An additional advantage of fabricating the thin lens plates as shown in FIGS. 28 and 28A is that by use of such unround apertures, the number of plates that will be required in the stacked, parallel array of lens plates possibly can be reduced, perhaps by a factor of 2.

In the embodiments of the invention described above, it should be understood that the thin conductive layer 33 on each side of the thin, apertured silicon lens plates (for dual-sided lens plates) or on the single side of the extremely thin lens plates (as shown in FIGS. 30 and 31 to be described hereafter) may comprise the highly conductive doped layer of silicon resulting from the processing of the starting silicon wafer without requiring that a further conductive coating or metalized layer of platinum, gold, silver or other heavy metal be disposed over the remaining surfaces of the thin, apertured silicon lens plates. Further, while the invention has been described primarily with relation to assemblies employing 3 or 4 lens plates, it is not limited to such structures. FIG. 29 of the drawings illustrates the preferred axial profile of a single channel of a micro lens array sub-assembly according to the invention which employs five (5) lens plates in the stacked array of parallel lens plates. In FIG. 29 the top plate 16 has the large diameter opening 32 in the highly conductive boron doped layer 33 exposed to the incoming electron beam with the smaller diameter beam limiting aperture 31 being located on the exit side of the plate. A second inlet lens plate 16A of similar construction is arranged in the same manner as 16. The center plate 17 to which the high focusing potential is applied has equal diameter apertures 36 and 37 formed on opposite sides thereof in the same manner as described with relation to FIG. 17. The two exit plates 18 and 18A have the small diameter limiting apertures 31 disposed on the upper surfaces thereof that are exposed to the incoming electron beam and the larger diameter apertures 32 are located on the beam exit side of the plates.

FIGS. 30 and 31 illustrate a somewhat different cross-sectional configuration for the lens plates of the micro lens array whereby extremely fine spacing between the plates can be obtained. The starting material is a wafer 181 of single crystalline silicon having a diameter of about 7–9 centimeters and a thickness of ½ millimeters. The wafer 181 is processed in a manner similar to the method described with relation to FIGS. 18A–18J using quite different masking patterns for the two sides of the wafer. On one side (which may be the upper side exposed to the incoming electron beam) a comparatively large rectangular opening 182 is left open to the action of the etchant and an array of fine aperture openings 31 having diameters of the order of one to two microns (1–2μ) is formed in the lower boron doped surface 33 of the wafer. The boron doped surface extends around the edges and over a substantial upper peripheral portion of the wafer as shown at 183 to provide sufficient rigidity and strength for mounting the resulting lens plate. Etching action through the top surface opening 182 is allowed to proceed all the way through the thickness of the wafer to the lower boron doped layer 33 defining the lens apertures 31. This action results in the formation of the tapered shoulders 184 extending between the matrix of apertures 31 on the lower surface and the upper peripheral portion 183. The resulting lens plate in the active area of the electron beam may have a thickness of the order of one to two microns (1–2μ) while defining lens apertures having diameters of the order of one to two microns (1–2μ) each thereby maximizing to the greatest possible extent the number of data bearing channels that can be designed into an electron beam accessed memory tube. The lens plate construction shown in FIGS. 30 and 31 could be used in any of the micro lens array sub-assemblies described in the preceding portions of the specification and even makes possible the design of practical assemblies employing only a single micro lens plate as the micro lens array sub-assembly. In such constructions, only the single lens plate shown in FIGS. 30 and 31 would be inserted for the micro lens sub-assembly 11 employed in the structures of FIGS. 1, 11, 21, 24, etc. While it might be possible to use a single lens plate fabricated as described withrelation to plate 16 in FIGS. 18A–18J of the drawings as a micro lens array sub-assembly, the construction of FIGS. 30 and 31 is preferred for single lens plate structures.

From the foregoing description, it will be appreciated that the perfection of the silicon etched symmetry and the precise geometrical control in three dimensions which is made possible by the boron diffusion and pyrocatechol and ethylene diamine etching action to limit the etching to predetermined locations, makes possible the fabrication of dramatically new and different lens plates for use on micro lens array elements. The steps in the preferred method of lens plate production are shown in FIG. 18 of the drawings. The technique employed makes possible the fabrication of two-layer structures where the aperture formed on one side of the lens plate has a different configuration from the aperture formed on the other, as described with relation to FIG. 28. Different shaped apertures "piggy-backed" on a single lens plate have been tried previously with photoetched metal plates. The problems encountered, however, were that the thin metal plates were not providing sufficiently round holes, were not staying in the plane and (being of a different metal in order to give selective etching characteristics) was also a bi-metallic plate subject to thermal warping. The doped silicon lens plates provided differential etching capability whereby different shaped apertures can be formed on opposite sides of the plate without introducing bi-thermal properties. Furthermore, where the apertured different configurations are "piggybacked" on the single lens plate, it is difficult to make the plate thick enough to cause the aperture to be placed outside the fringe field of the lens. Using boron doping and differential etching for definition of the aperture opening, sufficiently high quality holes can be formed on a "piggybacked" structure to make their use practical whereby fewer lens plates may be required in place of a larger number usually required in micro lens arrays fabricated from metal plates. This is made possible because control of the positioning of the aperture openings, their symmetry and size is of an order of magnitude improved over prior known constructions.

It should also be noted that in the fabrication of the micro deflector assembly, the fine micro deflector bars or blades are sawed from a solid block of silicon and the resulting blades or bars subsequently metalized. This procedure also is true for blades made from aluminum oxide ceramic or vitreous carbon as a starting material. Needless to say, the sawing of the individual blades and subsequent metalization of the blades requires individual processing of these parts and hence increases the cost of the micro deflector sub-assembly. For very large volume use, the cost per fine deflector unit can be reduced and the advantages of unitary construction achieved, i.e., pure materials, no bake-out limitations, stress free, and no vacuum pockets, by pyrolytic formation of polycrystalline silicon from halogen vapor into a graphite master mold conforming to the desired micro deflector sub-assembly sets of bladed structures. The process of such pyrolytic silicon formation of large complex objects is well established in the manufacture of polycrystalline silicon furnace tubes and furnace boats as described in the article entitled "The Preparation and Properties of CVD-Silicon Tubes and Boats for Semiconductor Device Technology", Journal of the Electrochemical Society, Vol. 121 (1974), page, 112–115, by W. Dietnze, L. P. Hunt and D. H. Sawyer. Thus, for large volume fabrication of the fine deflector sub-assemblies, in place of sawing out the individual blades and mounting them in two separate sets of interdigited, orthogonally arrayed, spaced-apart parallel bars as described above, four individual sets of bars can be fabricated initially from a master mold as described in the above-referenced article. Two sets may then be interdigited and mounted for x axis deflection and the remaining two sets interdigited and mounted for y axis deflection. The two sets of interdigited bars produced by the polycrystalline silicon then are arrayed at right angles to each other and alternate ones of the interdigited sets of bars appropriately interconnected electrically to operate in the previously described manner to provide −x, +x and −y, +y deflection.

Having described several embodiments of a new and improved micro lens array and micro deflector assembly for fly's eye type electron beam tubes constructed according to the invention, it is believed obvious that other modifications, variations and changes in the invention will be suggested to those skilled in the art in the light of the above teachings. It is therefore to be understood that changes may be made in the particular embodiments of the invention described which are within the full intended scope of the invention as defined by the appended claims.

What is claimed is:

1. A combined fine focusing micro lens array and micro deflector assembly for use in electron beam tubes of the fly's eye type comprising a fine focusing micro lens array sub-assembly formed by at least one thin planar apertured lens plate fabricated from silicon semiconductor material and having an array of micro lens aperture openings formed therein by photolithographic semiconductor microcircuit fabrication techniques, the apertured silicon lens plate having highly conductive surfaces and being secured to glass rods for holding the lens plate in parallel spaced-apart relationship relative to the micro deflector assembly with the plane of the lens plate substantially at right angles with respect to an electron beam path passing through the assembly, the apertures in the silicon lens plate being axially aligned along respective longitudinal axes passing through the center of the respective apertures parallel to the electron beam path and comprising an array of fine focusing lens elements, said combined fine focusing micro lens array and micro deflector assembly further including a micro deflector sub-assembly mounted immediately adjacent to said fine focusing micro lens array sub-assembly and defining a honeycomb matrix of sets of orthogonally disposed micro deflector elements there being a set of orthogonally disposed micro deflector elements axially aligned with each respective fine focusing lens element along a respective longitudinal axis for deflecting an electron beam passing through the respective fine focusing micro lens array element along orthogonal x-y directional axes of movement in a plane normal to the electron beam path.

2. A combined micro lens array and micro deflector assembly according to claim 1 wherein the fine focusing micro lens array sub-assembly comprises a multiplicity of spaced-apart stacked parallel thin planar apertured lens plates each fabricated from silicon semiconductor and each having an array of aperture openings formed therein, the respective aperture openings in each of the lens plates being axially aligned along a respective longitudinal axis with corresponding aperture openings in the remaining lens plates.

3. A combined micro lens array and micro deflector assembly according to claim 2 wherein said honeycomb matrix of sets of micro deflector elements are comprised by orthogonally arrayed interdigited sets of parallel spaced-apart deflector bars which define the respective orthogonally arrayed sets of micro deflector elements with alternate bars of each set of deflector bars being interconnected electrically for common connection to a respective source of fine x-y deflection potential.

4. A combined micro lens array and micro deflector assembly according to claim 3 wherein each of the thin planar apertured lens plates comprise thin single crystalline silicon wafers having lens aperture openings etched through nondoped areas thereof by a suitable etchant which attacks the nondoped areas of the wafer where the aperture openings are to be formed but does not attack highly doped surface areas of the wafer where no aperture openings are to be formed, said highly doped surface areas being formed by diffusionof a suitable dopant into the surface of the wafer to a suitable thickness of the order of 2 to 4 microns dependent upon the thickness of the wafer with subsequent exposure of the wafer to the etchant to thereby form an array of fine focusing lens aperture openings of precise dimension and exceptional symmetry on each wafer.

5. A combined micro lens array and micro deflector assembly according to claim 4 wherein after completion of etching of the matrix of aperture openings in each of the thin single crystalline silicon plates all the way through the thickness of the plate, the remaining planar surface area of the plate is left with highly conductive characteristics due to the heavy diffusion of a dopant such as boron into the remaining planar surface area to provide the desired differential etching characteristics required during etching formation of the aperture openings.

6. A combined micro lens array and micro deflector assembly according to claim 5 wherein each of the thin planar apertured lens plates comprises a thin planar wafer of single crystalline silicon about 2 microns thick having a matrix of aperture openings formed therein by etching from one side only all the way through the thickness of the wafer at precise points defined by the masking area formed on the surface of the wafer where no aperture openings are to exist with the masked area being impervious to the etchant employed in forming the aperture openings.

7. A combined micro lens array and micro deflector assembly according to claim 5 wherein the thin planar apertured lens plates each comprise a thin planar single crystalline silicon wafer of about 178 millimeter thickness etched from each of the opposite planar sides thereof through appropriately formed aperture opening areas defined by suitable masking of the surfaces of the wafer where no openings are desired and application of an etchant to both sides of the wafer.

8. A combined micro lens array and micro deflector assembly according to claim 5 wherein the dopant is boron and the etchant is a pyrocatechol ethylene diamine.

9. A combined micro lens array and micro deflector assembly according to claim 5 wherein the orthogonally arrayed sets of parallel spaced-apart deflector bars are comprised of elongated flat bars of polycrystalline silicon having a metalized surface.

10. A combined micro lens array and micro deflector assembly according to claim 9 wherein the planar apertured silicon lens plates comprising the micro lens array are held together in stacked parallel assembled relationship by spaced-apart glass rod supports whose longitudinal axes extend at right angles to the plates and to which the planar silicon lens plates are secured near their periphery and wherein the two orthogonally arrayed sets of parallel spaced-apart deflection bars comprising the sets of micro deflector elements are held in assembled spaced-apart parallel relationship by respective sets of spaced-apart parallel supporting glass rods whose longitudinal axes extend in a plane parallel to the plane of the deflector bars but at right angles thereto and to which the ends of the deflector bars are thermally bonded.

11. A combined micro lens array and micro deflector assembly according to claim 10 further including respective annularly-shaped outer support rings for the micro lens array sub-assembly and for the micro deflector sub-assembly comprised of molybdenum, tungsten or some other suitable material and to which the glass support rods of the respective sub-assembly are secured by fusion or otherwise.

12. A combined micro lens array and micro deflector assembly according to claim 11 further including electrically conductive termination plate means mounted parallel to said stacked parallel spaced-apart silicon plates and having apertures formed therein axially aligned with the array of micro lens elements formed by the aligned apertures in the stacked parallel thin silicon lens plates and with the micro defector elements, said termination plate means being mounted on the entrance side of the micro lens array relative to the direction of an electron beam projected through the assembly, said termination plate means being secured to and supported by an outer support ring in common with said micro lens array for mounting said termination plate means and said micro lens array in assembled relation with said micro deflector sub-assembly.

13. A combined micro lens array, micro deflector and target assembly according to claim 12 further including a planar target electrode member fabricated from silicon semi-conductor material mounted in a plane parallel to said thin apertured silicon plates and to the plane of said deflector bars and axially spaced apart therefrom in a direction extending along the path of an electron beam exiting the assembly after passing therethrough, said target electrode member being secured at its outer peripheral edge to an outer support ring used in mounting the target electrode member in assembled relation with the micro lens array and micro deflector sub-assemblies.

14. A combined micro lens array, micro deflector and target assembly according to claim 13 wherein the support ring secured in common to said termination plate means and said fine focusing micro lens array, the support ring secured to said micro deflector sub-assembly and the support ring secured to the target electrode member all in turn are secured at their peripheral edges to additional axially extending glass supporting rods whose longitudinal axes extend at right angles to the planes of the termination plate, the micro lens array, the micro deflector sub-assembly and the target electrode member.

15. A combined fine focusing micro lens array and micro deflector assembly according to claim 14 wherein the annularly-shaped outer support rings for each of the fine focusing micro lens array sub-assembly and the micro deflector sub-assembly have suitable locating notches formed in the peripheries thereof for maintaining axial alignment of the lens aperture openings in the thin silicon lens plates during assembly and for maintaining axial alignment of the micro deflector lens elements with the respective fine focusing micro lens aperture openings during assembly of the two sub-assemblies, the support rings for the termination plate and the target electrode member also including locating notches for maintaining axial alignment of these members with the micro lens array and micro deflector sub-assemblies.

16. A combined micro lens array and micro deflector assembly according to claim 14 wherein proper axial alignment of the aperture openings in the thin silicon lens plates of the micro lens array sub-assembly and the respective aligned set of micro deflector elements is obtained by light optical or electron optical alignment techniques together with proper axial alignment with the aperture openings in the termination plate and with the target electrode member.

17. A combined micro lens array and micro deflector assembly according to claim 16 wherein the thin planar apertured silicon lens plates and the fine deflector bars are thermally bonded to the glass support rods by electron beam heating or laser beam heating and fusion jointure.

18. A combined micro lens array and micro deflector assembly according to claim 14 wherein electrical connection to the thin apertured silicon lens plates of the micro lens array sub-assembly is obtained by trapping an exposed portion of a conductive wire between the hot glass of at least one of the support glass rods and the conductive surface of the respective lens plate during thermal bonding of the lens plates to the glass support rods and electrical connection to respective bars of the micro deflector sub-assembly is obtained by thermally bonding a thin flat conductive wire to the ends of alternate deflector bars at respective ends of each set of deflector bars.

19. A combined micro lens array and micro deflector assembly according to claim 1 or 3 wherein each of the thin planar apertured lens plates comprises a thin planar wafer of single crystalline silicon about 1 to 2 microns thickness having a matrix of aperture openings formed therein of about 1–2 microns diameter by etching from one side only all the way through the thickness of the wafer at precise points defined by a masking area formed on the surface of the wafer where no aperture openings are to exist with the masked area being impervious to the etchant employed in forming the aperture openings.

20. A combined micro lens array and micro deflector assembly according to claim 1 or 3 wherein the thin planar apertured lens elements each comprise a thin planar single crystalline silicon wafer of about ½ millimeter thickness etched from each of the opposite planar sides thereof through openings defined by a masking area formed on both planar surfaces of the wafer where no openings are to be formed and application of a suitable etchant to both sides of the wafer.

21. A combined micro lens array and micro deflector assembly according to claim 1 or 3 wherein the planar apertured silicon lens plates comprising the micro lens array are held together in stacked parallel assembled relationship by spaced-apart glass rod supports whose longitudinal axes extend at right angles to the plates and to which the planar silicon lens plates are secured at their periphery.

22. A combined micro lens array and micro deflector assembly according to claim 21 further including respective annularly-shaped outer support rings for the micro lens array sub-assembly and for the micro deflector sub-assembly comprised of molybdenum, tungsten or some other suitable material and to which the glass support rods of the respective sub-assembly are secured by thermal bonding or otherwise.

23. A combined fine focusing micro lens array and micro deflector assembly according to claim 22 wherein the annularly-shaped outer support rings for each of the fine focusing micro lens array sub-assembly and the micro deflector sub-assembly have suitable locating notches formed in the peripheries thereof for maintaining axial alignment of the lens aperture openings in the thin silicon lens plates during assembly and for maintaining axial alignment of the micro deflector lens elements with the respective fine focusing micro lens aperture openings during assembly of the two sub-assemblies.

24. A combined micro lens array and micro deflector assembly according to claim 21 wherein proper axial alignment of the aperture openings in the thin silicon lens plates of the micro lens array sub-assembly and the respective aligned set of micro deflector elements is obtained by light optical or electron optical alignment techniques.

25. A combined micro lens array and micro deflection assembly according to claim 1 or 3 further including electrically conductive termination plate means mounted parallel to said silicon lens plate and having apertures formed therein axially aligned with the array of micro lens elements formed by the apertures in the thin silicon lens plate and the axially aligned micro deflector elements, said termination plate means being mounted on the entrance side of the micro lens array relative to the direction of an electron beam projected through the assembly.

26. A combined micro lens array, micro deflector and target assembly according to claim 1 or 3 further including a planar target electrode member fabricated from silicon semi-conductor material mounted in a plane parallel to said thin apertured silicon plates and to the plane of said deflector bars and axially spaced apart therefrom in a direction extending along the path of an electron beam exiting the assembly after passing therethrough.

27. A combined micro lens array and micro deflector assembly according to claim 1 or 3 wherein said fine focusing micro lens array and said micro deflector sub-assembly are secured in assembled relation by axially extending glass support rods whose longitudinal axes extend at right angles to the plane of micro lens array and the plane of the micro deflector sub-assemblies.

28. A combined micro lens array and micro deflector assembly according to claim 27 wherein the thin planar apertured silicon lens plates and the fine deflector bars are thermally bonded to the glass support rods by electron beam heating or laser beam heating and fusion jointure.

29. A combined micro lens array and micro deflector assembly according to claim 27 wherein the stacked parallel array of thin apertured silicon lens plates comprising the micro lens array are held in spaced-apart parallel relationship by a common set of axially extending glass support rods to which the lens plates are directly secured and whose longitudinal axes extend at right angles to the plane of the lens plates and wherein the micro deflector sub-assembly is held in assembled relationship by respective sets of glass support rods which have the longitudinal axis thereof extend in a plane parallel to the plane of the deflection bars but at right angles thereto and to which the ends of the respective sets of deflector bars are thermally bonded, the deflector bars are comprised of elongated flat bars of polycrystalline silicon having a metalized surface, and the glass support rods to which the deflector bars are secured are in turn secured in common to the same set of axially extending glass support rods holding the apertured silicon lens plates for mounting the micro deflector sub-assembly in juxtaposed parallel relationship to said micro lens array.

30. A combined micro lens array and micro deflector assembly according to claim 29 wherein the end deflector bars only of each set of deflector bars is comprised of malleable metal such as tungsten and have extensions extending beyond the point of connection to the glass rods supporting the deflector bars in assembled relation, said extensions being shaped to form mounting tabs for securing the micro deflector sub-assembly to the axially extending glass support rods with the micro lens array in juxtaposed parallel relation thereto.

31. A combined micro lens array and micro deflector assembly according to claim 29 wherein the ends of the common set of axially extending glass support rods are shaped to seat with and support the bonded to a precision insulating sapphire ball that in turn is seated in and thermally bonded to a socket formed in an annularly-shaped support ring for mounting the assembly within the housing of a fly's eye type electron beam tube.

32. A combined micro lens array and micro deflector assembly according to claim 31 further including an electrically conductive termination plate mounted parallel to said thin apertured silicon lens plates and having apertures formed therein axially aligned with the array of micro lens elements formed by the axially aligned apertures in the stacked spaced-apart parallel silicon lens plates and with the micro deflector elements, said termination plate being mounted directly to the common set of axially extending glass support rods used to hold the combined micro lens array and micro deflector assembly in assembled relation on the entrance side of the assembly relative to the direction of an electron beam travelling therethrough, and further including a planar target electrode member secured to the common set of axially extending glass support rods parallel to the thin apertured silicon lens plates and the plane of the deflector bars and spaced apart therefrom in a direction extending along the path of an electron beam exiting the assembly after passing therethrough.

33. A combined micro lens array and micro deflector assembly according to claim 29 wherein electrical connection to the thin apertured silicon lens plates of the micro lens array sub-assembly is obtained by trapping an exposed portion of a conductive wire between the hot glass of at least one of the support glass rods and the conductive surface of the respective lens plate during thermal bonding of the lens plates to the glass support rods and electrical connection to the respective bars of the micro deflector sub-assembly is obtained by thermally bonding a thin flat conductive wire to the ends of alternate deflector bars at respective ends of each set of deflector bars.

34. A combined micro lens array and micro deflector assembly according to claim 1 or 3 wherein electrical connection to at least one of the thin apertured silicon lens plates of the micro lens array sub-assembly is obtained by trapping an exposed portion of a conductive wire between the hot glass of at least one of the glass support rods and the conductive surface of the respective plate during thermal bonding of the plates to the glass support rods with the conductive wire thereafter being connected by conventional lead-in insulated conductor to a source of electrical energy.

35. A combined micro lens array according to claim 34 wherein the exposed portion of the conductive wire is formed from a material which alloys with silicon.

36. A combined micro lens array and micro deflector assembly according to claim 1 or 3 wherein the glass support rods at the point of thermal bonding to the silicon lens plates have suitable projections extending inwardly to contact the peripheral edge portions of the silicon plates at the point of connection whereby the effective insulator distance between the adjacent silicon plates can be made to be much greater than the plate separation distance.

37. A combined micro lens array and micro deflector assembly according to claim 36 wherein the inwardly extending projection comprises inwardly extending glass branches extending substantially normal to the main trunk of the vertically extending glass support rods.

38. A combined micro lens array and micro deflector assembly according to claim 36 wherein the glass support rods themselves are bent or shaped outwardly away from the point of connection thereof to the thin apertured silicon lens plates whereby greater insulator spacing is achieved between adjacent silicon plates in comparison to the plate separation distance.

39. A combined micro lens array and micro deflector assembly according to claim 1 or 3 wherein the aperture openings formed in at least one side of one of the thin apertured silicon lens plates are not round but are semi-elliptical in configuration for reducing third order aberrations.

40. A combined micro lens array and micro deflector assembly according to claim 1 or 3 wherein ring-shaped pads of increased thickness compatible material are secured to points around the periphery of the thin silicon apertured lens plates for increasing the thickness thereof, and a plurality of insulating ball spacers are seated in the ring-shaped pads for assembling the thin silicon lens plates in a stacked spaced-apart parallel array upon being clamped together in a self-supporting structure.

41. A combined micro lens array and micro deflector assembly according to claim 1 or 3 wherein a plurality of support holes are formed around the peripheral edge portion of at least one of the thin silicon apertured lens plates and a plurality of small insulating ball spacers are seated in the holes for providing an insulating mounting means for the respective thin silicon lens plate.

42. A combined micro lens array and micro deflector assembly according to claim 1 or 3 further including a planar target member of electron sensitive material removably mounted by a vacuum-tight enclosure housing in common with and in a plane parallel to said thin apertured micro lens silicon plates and to the plane of said micro deflector bars and axially spaced apart therefrom in a direction extending along the path of an electron beam exiting the assembly after passing therethrough.

43. A fine focusing micro lens array sub-assembly for use in electron beam tubes of the fly's eye type comprising at least one thin planar apertured lens plate fabricated from silicon semiconductor material and having a matrix of aperture openings formed therein by photolithographic semiconductor microcircuit fabrication techniques, the apertured silicon lens plate having highly conductive surfaces and being secured near the periphery to glass support rods for holding the plate in parallel spaced-apart relationship with the apertures axially aligned in parallel with a longitudinal axis passing through the center of the plate to form an array of fine focusing lens elements for an electron beam, the glass support rods having the longitudinal axes thereof extending at right angles to the plane of the thin apertured silicon lens plate and being thermally bonded thereto.

44. A fine focusing micro lens array sub-assembly according to claim 43 wherein the thin apertured silicon lens plate comprises a thin planar wafer of single crystalline silicon about 2 microns thick and having a matrix of aperture openings formed therein by etching from one side only all the way through the thickness of a starting wafer at precise points defined by a masking area formed on the surface of the wafer where no aperture openings are to exist with the masked area being impervious to the etchant employed in forming the aperture openings.

45. A combined micro lens array and micro deflector assembly according to claim 43 wherein the fine focusing micro lens array sub-assembly comprises a multiplicity of spaced-apart stacked parallel thin planar apertured lens plates each fabricated from silicon semiconductor and each having an array of aperture openings formed therein, the respective aperture openings in each of the lens plates being axially aligned along a respective longitudinal axis with corresponding aperture openings in the remaining lens plates.

46. A fine focusing micro lens array sub-assembly according to claim 45 wherein the thin apertured silicon lens plates comprise a thin planar single crystalline silicon wafer of about ½ millimeter thickness etched all the way through from both of the opposite planar sides thereof through openings defined by a masking area formed on both planar surfaces of the wafer where no openings are desired and application of a suitable etchant to the unmasked areas on both sides of the wafer.

47. A fine focusing micro lens array sub-assembly according to claim 43 or 45 wherein each of the thin apertured silicon lens plates comprise a thin single crystalline silicon wafer having lens aperture openings etched through nondoped areas thereof by a suitable etchant which attacks the nondoped areas of the wafer where the aperture openings are to be formed but does not attack highly doped surface areas of the wafer where no aperture openings are to be formed, said highly doped surface areas being formed by diffusion of a suitable dopant into the surface of the wafer to a thickness of the order of 2 to 4 microns dependent upon the thickness of the wafer with subsequent exposure of the wafer to the etchant to thereby form an array of fine focusing lens aperture openings of precise dimension and exceptional symmetry on each wafer.

48. A micro lens array sub-assembly according to claim 47 wherein after completion of etching of the matrix of aperture openings in each of the thin single crystalline silicon plates all the way through the thickness of the plates, the remaining planar surface area of the plate is left with highly conductive characteristics due to the heavy diffusion of a dopant such as boron into the remaining planar surface area to provide the desired differential etching characteristics required during etching formation of the aperture openings.

49. A micro lens array sub-assembly according to claim 48 wherein each of the thin apertured silicon lens plates comprises a thin planar wafer of single crystalline silicon about 2 microns thick and having a matrix of aperture openings formed therein by etching from one side only all the way through the thickness of the wafer at precise points defined by the masking area formed on the surface of the wafer where no aperture openings are to exist with the masked surface areas being impervious to the etchant employed in forming the aperture openings.

50. A micro lens array sub-assembly according to claim 48 wherein the thin planar apertured lens plates each comprise a thin planar single crystalline silicon wafer of about ½ millimeter thickness etched from each of the opposite planar sides thereof through photolithographically formed aperture opening areas defined by suitable masking of the surfaces of the wafer where no aperture openings are desired and application of an etchant to both sides of the wafer.

51. A micro lens array sub-assembly according to claim 48 wherein the dopant is boron and the etchant is pyrocatechol ethylene diamine.

52. A micro lens array sub-assembly according to claim 51 further including an annularly-shaped outer support ring for the micro lens array sub-assembly comprised of molybdenum, tungsten or other suitable metal with the glass support rods being thermally bonded to the inner peripheral edge portions thereof and with the support ring of metal having suitable locating notches formed in the periphery thereof for maintaining axial alignment of the sub-assemblies with other sub-assemblies comprising a fly's eye electron beam tube.

53. A micro lens array sub-assembly according to claim 43 or 45 wherein electrical connection to the thin apertured silicon lens plates is obtained by trapping an exposed portion of a thin conductive wire between the hot glass of at least one of the glass support rods and the conductive surface of the respective plate during thermal bonding of the plates to the glass support rods with the conductive wire thereafter being connected by conventional lead-in insulated conductor to a source of electric energy.

54. A micro lens array sub-assembly according to claim 43 or 45 wherein the glass support rods at the point of thermal bonding to the thin silicon lens plates have suitable projections extending inwardly to contact the peripheral edge portions of the silicon plates at the point of connection whereby the effective insulator distance between silicon plates and other parts can be made to be much greater than the plate separation distance.

55. A micro lens array sub-assembly according to claim 43 or 45 wherein the aperture openings formed in at least one side of one of the thin apertured silicon lens plates are not round but are semi-elliptical in configuration for reducing third order aberrations.

56. A micro lens array sub-assembly according to claim 43 or 45 wherein ring-shaped thickened pads of compatible conductive material are secured to points around the peripheral edge portions of the thin silicon apertured lens plates for increasing the thickness thereof and a plurality of insulating ball spacers are seated in the ring-shaped pads for assembling the thin silicon lens plates in a stacked spaced-apart parallel array upon being clamped together in a self-supporting structure.

57. A micro lens array sub-assembly according to claim 43 or 45 wherein a plurality of support holes are formed around the periphery of the thin silicon apertured lens and a plurality of small insulating ball spacers are seated in and thermally bonded to the holes for providing an insulating mounting means for the respective lens plates.

58. A micro deflector sub-assembly for use in electron beam tubes of the fly's eye type comprising a honeycomb matrix of sets of orthogonally disposed micro deflector elements there being a set of orthogonally disposed micro deflector elements axially aligned with each respective electron beam path for deflecting an electron beam along orthogonal x-y directional axes of movement in a plane normal to the electron beam path, said honeycomb matrix of sets of micro deflector elements being comprised by two orthogonally arrayed sets of two interdigited parallel spaced-apart deflector bars which define the respective orthogonally arrayed sets of micro deflector elements with alternate bars of each set of deflector bars being interconnected electrically for common connection to a respective source of fine x-y deflection potential and each of said deflector bars being fabricated from silicon and having a highly conductive surface formed thereon.

59. A micro deflector assembly according to claim 58 wherein the silicon deflector bars comprise polycrystalline silicon.

60. A micro deflector assembly according to claim 58 wherein the two orthogonally arrayed sets of parallel spaced-apart silicon deflector bars comprising the micro deflector elements are held in assembled spaced-apart parallel relationship by respective sets of spaced-apart parallel supporting glass support rods whose longitudinal axes extend in a place parallel to the plane of the sets of parallel spaced-apart deflector bars but at right angles to the longitudinal extent of the bars and with the ends of the deflector bars being thermally bonded to the glass support rods.

61. A micro deflector sub-assembly according to claim 60 wherein at least the end of the end deflector bars of each set of deflector bars is comprised of a metal such as tungsten and extend beyond the point of connection to the glass support rods holding the deflector bars in assembled relation, said extensions being shaped to form mounting tabs for mounting the micro deflector sub-assembly in a fly's eye electron beam tube.

62. A micro deflector sub-assembly according to claim 60 further including an outer annularly-shaped support ring comprised of molybdenum, tungsten or other suitable material to which the parallel supporting glass support rods are thermally bonded for mounting the micro deflector sub-assembly in a fly's eye electron beam tube.

63. A micro deflector sub-assembly according to claim 60 wherein the micro deflector sub-assembly is held in assembled relationship with other sub-assemblies and components of the fly's eye electron beam tube by an additional set of axially extending glass support rods which have the longitudinal axis thereof extend at right angles to the plane of the deflector bars.

64. A micro deflector sub-assembly according to claim 63 wherein the first mentioned parallel supporting glass support rods extend to and engage the axially extending glass support rods and are thermally bonded thereto.

65. A micro deflector sub-assembly according to claim 63 wherein at least the end of the deflector bars of each set of deflector bars is comprised of a malleable metal such as tungsten and extend beyond the point of connection to the parallel supporting glass rods, said malleable metal extension being bent over to engage and thermally bond to respective axially extending glass support rods.

66. A micro deflector sub-assembly according to claim 63 further including an annularly-shaped support ring comprised of molybdenum, tungsten or other suitable material to which the parallel supporting glass rods are bonded at different points around the inner periphery thereof, the axially extending glass support rods being thermally bonded to the metal support ring at different points around the outer periphery thereof.

67. The method of fabricating micro lens array plates from round, thin planar single crystalline silicon semiconductor wafers of about ½ millimeter thickness or less comprising the steps of:

(a) growing a wet silicon dioxide layer on both flat planar surfaces of the silicon wafer to a thickness of several hundred Angstrom units;

(b) by photolithographic techniques employing a photo-resist and solvent for silicon dioxide form an array of silicon dioxide dots on both surfaces of the silicon wafer where it is desired that aperture openings be formed with the centers of each set of opposing silicon dioxide dots on the opposite surfaces of the silicon wafer being axially aligned on a common axis passing through both centers and perpendicular to the plane of the wafer;

(c) spin coat a boron containing emulsion over both silicon dioxide dotted flat surfaces of the wafer and fire wafer in a nitrogen atmosphere at substantially 1100° C., to thereby grow a heavily boron doped layer of about 2 microns thickness in surface areas of wafer where it is desired that no aperture openings be formed;

(d) remove excess boron containing emulsion in a hydrofluoride bath and remove silicon dioxide dots in a fresh hydrofluoride bath to leave a deep heavily boron doped and highly conductive layer of about 2 microns thickness in those planar surface areas on both sides of the wafer where it is desired that no apertures be formed interspersed with an array of dotted updoped silicon surface areas where it is desired that apertures be formed;

(e) etching the wafer in an etchant comprising a hot pyrocatechol and ethylene diamine bath which attacks the dotted undoped silicon surface areas of the wafer previously protected by the silicon dioxide dots during the boron doping step at a faster differential rate than it attacks the boron doped surface areas; and (f) continuing the etching until an array of lens aperture openings of a desired diameter have been formed all the way through the thickness of the wafer by the meeting of the simultaneously etched pockets produced on both sides of the wafer by the differential etching action of the etchant on the dotted undoped silicon surface areas.

68. The method according to claim 67 wherein the size of the dots of silicon dioxide formed on one flat planar surface of the silicon wafer is greater than the size of the silicon dioxide dots formed on the opposite surface thereby resulting in an array of aperture openings through the micro lens array plate which have a greater dimension on one side of the plate than the aperture openings on the opposite side.

69. The method according to claim 67 wherein the shape of the silicon dioxide dots formed on opposite flat planar surfaces of the silicon wafer are differently shaped resulting in the formation of an array of aperture openings through the wafer whose shape on one side of the wafer are substantially different from the shape of the aperture openings on the opposite side.

70. The product of the method of fabrication according to claim 67.

71. The product of the method of fabrication according to claim 68.

72. The product of the method of fabrication according to claim 69.

73. The product according to any of claim 67 or 68 or 69 wherein alignment marks are provided on portions of the starting silicon wafer to facilitate alignment of the plates during aperture formation using the photolithographic masks and during subsequent thermal bonding of the apertured plates to glass support rods.

74. The method of fabricating micro lens array plates from round, thin planar single crystalline silicon semiconductor wafers of about ½ millimeter thickness comprising the steps of:

(a) growing a wet silicon dioxide layer on one flat planar surface to a thickness of several hundred Angstrom units;

(b) by photolithographic techniques employing a photo resist and solvent for silicon dioxide produce an array of silicon dioxide dots where it is desired that aperture openings be formed on one side only of the wafer;

(c) by photolithographic techniques employing a photo resist and solvent for silicon dioxide produce an enlarged area of unmasked silicon on the backside of the wafer corresponding to the area of desired aperture openings on the first mentioned side while leaving a substantial peripheral area of silicon dioxide masked silicon around the peripheral edges of the wafer;

(d) spin coat a boron containing emulsion over silicon dioxide masked surfaces of both sides of the wafer and fire the wafer in a nitrogen atmosphere at about 1100° C. to thereby grow a heavily boron doped layer of about 2 microns thickness through those surface areas of the wafer where it is desired that no aperture openings be formed;

(e) remove excess boron containing emulsion in a hydrofluoric bath and remove silicon dioxide mask in a fresh hydrofluoric bath to leave a deep heavily doped and highly conductive layer of about 2 microns thickness in those planar surface areas of the wafer where it is desired that no apertures be formed interspersed with an array of dotted undoped silicon surface areas where it is desired that apertures be formed;

(f) etching the wafer in an etchant comprising a hot pyrocatechol and ethylene diamine bath which attacks the undoped silicon surface areas of the wafer previously protected by the silicon dioxide dots during the boron doping step at a faster differential rate than it attacks the boron doped surface areas; and (g) continuing the etching action until an array of lens aperture openings of a desired diameter have been formed all the way through the thickness of the wafer by the differential etching action of the etchant on the dotted undoped silicon surface areas while leaving a substantial peripheral portion of the original starting wafer thickness to provide rigidity to the resultant lens plate.

75. The product of the method of fabrication according to claim 74.

76. The method according to claim 74 wherein alignment marks are provided on the starting silicon wafer to facilitate alignment of the plates during aperture formation using the photolithographic masks and during subsequent thermal bonding of the aperture plates to glass support rods.

* * * * *